US009881722B2

(12) United States Patent
Nishio et al.

(10) Patent No.: US 9,881,722 B2
(45) Date of Patent: Jan. 30, 2018

(54) COMPOSITE MAGNETIC BODY AND METHOD FOR MANUFACTURING SAME

(71) Applicant: Panasonic Intellectual Property Management Co., Ltd., Osaka (JP)

(72) Inventors: Shota Nishio, Osaka (JP); Takeshi Takahashi, Kyoto (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 257 days.

(21) Appl. No.: 14/436,878

(22) PCT Filed: Oct. 25, 2013

(86) PCT No.: PCT/JP2013/006324
§ 371 (c)(1),
(2) Date: Apr. 18, 2015

(87) PCT Pub. No.: WO2014/068928
PCT Pub. Date: May 8, 2014

(65) Prior Publication Data

US 2015/0287507 A1 Oct. 8, 2015

(30) Foreign Application Priority Data

Oct. 31, 2012 (JP) ..... 2012-240189
Jan. 18, 2013 (JP) ..... 2013-006905

(51) Int. Cl.
*H01F 3/08* (2006.01)
*H01F 1/08* (2006.01)
(Continued)

(52) U.S. Cl.
CPC ..... *H01F 3/08* (2013.01); *B22F 3/12* (2013.01); *B22F 3/26* (2013.01); *H01F 1/08* (2013.01);
(Continued)

(58) Field of Classification Search
CPC ..... H01F 3/08; H01F 41/0266; H01F 41/005; H01F 1/344; H01F 1/08; H01F 1/15375;
(Continued)

(56) References Cited

U.S. PATENT DOCUMENTS

2003/0012948 A1* 1/2003 Miura ..... H01F 41/026 428/328
2011/0024670 A1 2/2011 Otsuki et al.
(Continued)

FOREIGN PATENT DOCUMENTS

JP 2000-188214 7/2000
JP 2001-135515 5/2001
(Continued)

OTHER PUBLICATIONS

Machine translation of JP 2005347449 A, submitted in the IDS filed Apr. 18, 2015, 29 pages.*
(Continued)

*Primary Examiner* — Matthew E Hoban
*Assistant Examiner* — Lynne Edmondson
(74) *Attorney, Agent, or Firm* — McDermott Will & Emery LLP

(57) ABSTRACT

A composite magnetic body includes metal magnetic powder formed of metal magnetic particles and an insulator impregnated into at least a part of voids among the metal magnetic particles. On a cumulative curve of widths of the voids among the metal magnetic particles, a void width at which a cumulative distribution is 50% is equal to or smaller than 3 μm, and a void width at which the cumulative distribution is 95% is equal to or greater than 4 μm.

18 Claims, 2 Drawing Sheets

(51) Int. Cl.

| | |
|---|---|
| ***B22F 3/26*** | (2006.01) |
| ***H01F 1/26*** | (2006.01) |
| ***H01F 41/02*** | (2006.01) |
| ***B22F 3/12*** | (2006.01) |
| ***H01F 41/00*** | (2006.01) |
| *C22C 33/02* | (2006.01) |
| *B22F 3/24* | (2006.01) |
| *B22F 1/00* | (2006.01) |
| *B22F 3/02* | (2006.01) |

(52) U.S. Cl.

CPC ..... *H01F 1/26* (2013.01); *H01F 41/005* (2013.01); *H01F 41/0246* (2013.01); *H01F 41/0266* (2013.01); *B22F 1/0011* (2013.01); *B22F 2003/023* (2013.01); *B22F 2003/248* (2013.01); *B22F 2998/10* (2013.01); *C22C 33/02* (2013.01); *C22C 2202/02* (2013.01)

(58) Field of Classification Search

CPC ..... H01F 1/14708; H01F 1/14741; H01F 2017/048; H01F 27/24; B22F 3/26; B22F 3/12; B22F 2301/35; B22F 2302/25; B22F 2304/10; C22C 38/02; C22C 38/06; C22C 38/08; C22C 38/34; C22C 19/03; C22C 2202/02; Y10T 428/249956; B82Y 30/00

USPC ..... 252/62.55, 62.54, 62.62, 62.64, 62.56; 148/105

See application file for complete search history.

(56) References Cited

U.S. PATENT DOCUMENTS

| | | | | |
|---|---|---|---|---|
| 2012/0176725 | A1* | 7/2012 | Yoshida | C03C 11/007 361/321.1 |
| 2012/0274437 | A1 | 11/2012 | Matsuura et al. | |
| 2012/0306308 | A1* | 12/2012 | Nishiuchi | H01F 1/0573 310/156.01 |
| 2013/0057371 | A1* | 3/2013 | Shimoyama | B22F 1/0062 335/297 |
| 2013/0286703 | A1 | 10/2013 | Inaba et al. | |
| 2013/0298730 | A1 | 11/2013 | Ikeda et al. | |

FOREIGN PATENT DOCUMENTS

| | | | | |
|---|---|---|---|---|
| JP | 2005-347449 | | 12/2005 | |
| JP | 2005347449 | A * | 12/2005 | |
| JP | 2008-192897 | | 8/2008 | |
| JP | 2010-153638 | | 7/2010 | |
| JP | 4906972 | B | 3/2012 | |
| WO | WO 2007135981 | A1 * | 11/2007 | H01F 1/0573 |
| WO | 2009/128425 | | 10/2009 | |
| WO | 2010/095496 | | 8/2010 | |
| WO | 2012/115137 | | 8/2012 | |
| WO | 2012/128037 | | 9/2012 | |

OTHER PUBLICATIONS

International Search Report of PCT application No. PCT/JP2013/006324 dated Dec. 3, 2013.

* cited by examiner

COMPOSITE MAGNETIC BODY AND METHOD FOR MANUFACTURING SAME

TECHNICAL FIELD

The present invention relates to a composite magnetic body to be used in an inductance component such as an inductor, choke coil, and transformer, and also to a method for manufacturing the same.

BACKGROUND ART

In recent years, electronic apparatuses have been downsized, and they use large amounts of electric current. This market trend requires inductance components employed in these electronic apparatuses to be downsized, and yet to be driven by large amounts of electric current.

An inductance component is chiefly formed of a coil and a magnetic material inserted in the coil. The magnetic material used in the inductance component falls into two main groups, namely, a ferrite core and a powder magnetic core as a composite magnetic body. Since the ferrite core has so small saturation magnetization, it tends to be encountered by magnetic saturation. In the presence of large amounts of electric current needed for the recent electronic apparatuses, a magnetic permeability of the ferrite core thus remarkably decreases. Some measures are taken against this problem: a cross section through which the magnetic flux of the ferrite core travels is enlarged; or a gap is disposed in the ferrite core to suppress the magnetic saturation to occur. However, the enlargement of the cross section causes the inductance component to be bulky, and the employment of the gap causes a leakage flux that invites an increase of eddy current loss at the coil, and also produces noises to peripheral components. It is thus difficult for the existing techniques to achieve a ferrite core that is downsized and driven by a large amount of electric current.

On the other hand, the powder magnetic core produced by compressing and molding the metal magnetic powder has a greater saturation magnetization, so that its magnetic permeability decreases by a smaller amount than the ferrite core in the situation of using the large amount of electric current. The powder magnetic core is thus useful for manufacturing the inductance components that can be driven by large amounts of electric current and downsized.

The powder magnetic core needs a certain mechanical strength in order to suppress cracks or breakages in manufacturing or in use, and to increase the yield or to enhance the reliability.

To increase a mechanical strength of the composite magnetic body, a filling factor of metal magnetic particles that form metal magnetic powder is conventionally increased, so that mechanical entanglement among the metal magnetic particles is facilitated and the mechanical strength of the powder magnetic core is increased. However, the increase in the filling factor of metal magnetic particles is not enough to obtain sufficient mechanical strength, so that it is difficult for this method to produce the powder magnetic core that has excellent magnetic properties as well as sufficient mechanical strength. Therefore, use of impregnation processing for improving the mechanical strength has been studied, and then a powder magnetic core of which mechanical strength and magnetic properties are improved by this method is disclosed. Related art to this method is disclosed in, for example, Patent Literatures 1 to 3.

Patent Literature 1 discloses the following method: metal magnetic powder is mixed with first binder as molding assistant agent to produce granulated powder, which is then pressurized and molded to produce a compact. This compact undergoes a thermal treatment, and then is impregnated with a second binder. The process discussed above allows increasing the mechanical strength.

Patent Literature 2 discloses that a polymeric resin is impregnated into at least a part of voids in a composite magnetic body, thereby increasing the mechanical strength.

Patent Literature 3 discloses that use of methacrylic acid diester as an impregnating resin allows suppressing the magnetic properties of the powder magnetic core to be lowered while the mechanical strength is effectively increased.

CITATION LIST

Patent Literature

PTL 1: International Publication No. 2009-128425

PTL 2: Examined Japanese Patent Publication No. 4906972

PTL 3: International Publication No. 2010-095496

SUMMARY OF THE INVENTION

The composite magnetic body of the present invention includes metal magnetic powder formed of metal magnetic particles and an insulator impregnated into at least a part of voids among the metal magnetic particles. In an ogive (i.e. cumulative distribution curve) of widths of the voids among the metal magnetic particles, a void width at which the cumulative distribution is 50% is equal to or smaller than 3 μm, and a void width at which the cumulative distribution is 95% is equal to or greater than 4 μm. The structure discussed above allows increasing the mechanical strength due to mechanical entanglement among the metal magnetic particles, and yet, this structure maintains enough voids among the metal magnetic particles for the insulator to permeate there with ease, thereby increasing the mechanical strength of the composite magnetic body effectively. Comparing with the composite magnetic body, in which the filling factor of the metal magnetic particle is increased to enhance the mechanical strength and the voids among the metal magnetic particles are minimized, the foregoing structure allows lowering a frequency in the contact among the metal magnetic particles. As a result, the insulation resistance of the composite magnetic body can be efficiently increased, which suppresses an eddy-current loss.

DESCRIPTION OF EMBODIMENTS

Each of the powder magnetic cores (composite magnetic body) disclosed in Patent Literatures 1 to 3 does not have enough mechanical strength. Hereinafter, a composite magnetic body excellent in mechanical strength and yet low in magnetic loss in accordance with a first embodiment of the present invention is described. A method for manufacturing this composite magnetic body is also demonstrated.

First Exemplary Embodiment

Figure 1:
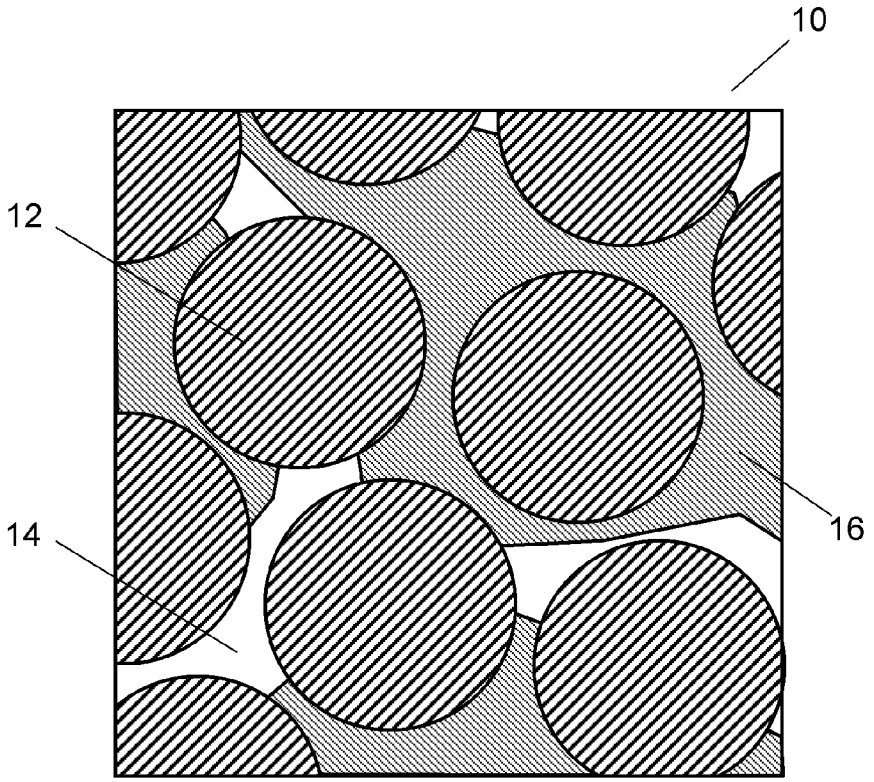
FIG. 1 is a schematic enlarged sectional view of a composite magnetic body in accordance with a first embodiment of the present invention.

FIG. 1 is a schematic enlarged sectional view of composite magnetic body 10 in accordance with the first embodiment of the present invention. Composite magnetic body 10 includes metal magnetic powder formed of metal magnetic particles 12, and insulating resin 16 that is an insulator impregnated into at least a part of voids 14 among metal magnetic particles 12.

The metal magnetic powder to be used in composite magnetic body 10 is not limited to a specific material; however, from the perspective of suppressing magnetic saturation in the situation of using a large electric current, the powder is preferably formed chiefly of iron because the iron has a high saturation magnetization. Besides the iron, materials for the metal magnetic powder include, for instance, Fe—Ni alloy, Fe—Si alloy, Fe—Al—Si alloy which contain additives such as Ni, Si, or Al in order to increase soft-magnetism properties, various kinds of amorphous alloy, and metal-glass alloy.

A method for manufacturing the metal magnetic powder is not limited to a specific way. Chemical synthesizing methods, which allow forming water-atomized powder, gas-atomized powder, and other atomized powders, or pulverized powder, carbonyl iron dust, are available for this manufacturing method. An average particle size of metal magnetic particles 12 falls preferably within a range from 1 μm to 100 μm, inclusive. The average particle size equal to or greater than 1 μm allows achieving a high molding density, which suppresses the magnetic permeability to be lowered. The average particle size equal to or smaller than 100 μm allows suppressing an eddy-current loss in a high frequency band. The average particle size equal to or smaller than 50 μm is more preferable for further preventing the eddy-current loss in the high frequency band.

A shape of metal magnetic particle 12 is not limited to a specific one, and the shape thereof can be selected, such as spherical shape or flat shape, depending on a purpose of usage.

An insulator can be added to the composite magnetic body in accordance with this embodiment in order to strengthen the quality of insulation among metal magnetic particles 12. A type of the insulator is not limited to a specific one. The insulator can include various coupling agents such as silane coupling agent, and titanate coupling agent, or various fillers such as aluminum oxide, silicon oxide, titanium oxide, magnesium oxide, boron nitride, aluminum nitride, silicon nitride, mica, talc, and kaolin, or silicone resin. An additive quantity of the insulator is preferably equal to or greater than 0.01 wt %. A quantity of the insulator smaller than 0.01 wt % fails to sufficiently insulate each of metal magnetic particles 12 from each other, so that an effect of adding the insulator cannot be performed. Note that forming an oxide film or a phosphate film on surfaces of metal magnetic particles 12 can strengthen the quality of insulation between metal magnetic particles 12 instead of adding the insulator.

When composite magnetic body 10 in accordance with this embodiment undergoes a pressure molding, a polymer having binding property is added as a molding assistant agent in order to increase moldability. The polymer is not limited to a specific material, and it can employ silicone resin, butyral resin, acrylic resin, epoxy resin, phenol resin, or the like. The acrylic resin among them is easily decomposed during the heat treatment, and leaves little residue, so that the voids among metal magnetic particles 12 are seldom blocked by the residue. Use of the acrylic resin thus allows insulating resin 16 to permeate composite magnetic body 10 more efficiently. As a result, composite magnetic body 10 having mechanical strength remarkably enhanced is obtainable.

An additive amount of the molding assistant agent should be equal to or greater than 0.01 wt % with respect to the metal magnetic powder. An additive amount less than 0.01 wt % fails to obtain sufficient shape retention of composite magnetic body 10, so that handling of composite magnetic body 10 in manufacturing steps is degraded. A total additive amount of the insulator and the molding assistant agent to composite magnetic body 10 in accordance with this embodiment is preferably equal to or smaller than 10 wt %. A total additive amount greater than 10 wt % lowers the filling factor of metal magnetic particles 12, so that the magnetic permeability of composite magnetic body 10 is lowered. When an organic substance (coupling agent or resin) is used as the insulator, a ratio of the molding assistant agent with respect to a total amount of the insulator and the molding assistant agent is preferably equal to or greater than 50 wt %. Regarding the organic insulator, if the ratio of the molding assistant agent with respect to a total amount of the insulator and the molding assistant agent is lower than 50%, the insulator occupies the voids among metal magnetic particles 12 in a greater portion, so that it is difficult for the molding assistant agent to control the distribution of the voids. However, when the insulator serves as a function of the molding assistant agent, the foregoing worry is needless. For instance, silicone resin contains organic component which is decomposed by a heat treatment, and a resultant silicone compound serves as a function of an insulator, so that the silicone resin works both as the insulator and the molding assistant agent.

A lubricant such as various metal-stearates can be added in order to increase the fluidity or the filling factor of material powder during the pressure molding.

On the cumulative distribution curve of the widths of void 14 of composite magnetic body 10, the width of void 14 at which the cumulative distribution stands at 50% is equal to or smaller than 3 μm, and the width of void 14 at which the cumulative distribution stands at 95% is equal to or greater than 4 μm. Composite magnetic body 10 has the foregoing void distribution, so that it is excellent in mechanical strength and magnetic loss.

For a conventional composite magnetic body, it has been studied to minimize the voids among the metal magnetic particles for facilitating mechanical entanglement, thereby increasing the mechanical strength. It has been also studied to impregnate resin into the conventional composite magnetic body for improving the mechanical strength. However, the relation between the mechanical strength of the composite magnetic body into which resin is impregnated and the voids among the metal magnetic particles has not been systematically studied yet, and the void distribution among the metal magnetic particles has not been controlled.

Reviewing these points, the inventors find a clear relation among the void distribution, mechanical strength and magnetic loss of composite magnetic body 10. The inventors thus find out how to increase the mechanical strength remarkably by using the void distribution in the foregoing structure.

To be more specific, in the cumulative distribution of the widths of voids, the width of void 14 corresponding to the cumulative distribution of 50% is set to 3 μm or less, thereby facilitating the mechanical entanglement among metal magnetic particles 12. In addition, in the cumulative distribution of the widths of voids, the width of void 14 corresponding to the cumulative distribution of 95% is set to 4 μm or more, thereby securing voids 14 among metal magnetic particles 12 and facilitating insulating resin 16 to permeate voids 14. The width of void 14 at which the cumulative distribution stands at 50% is set to 3 μm or less, and yet the width of void 14 at which the cumulative distribution stands at 95% is set to 4 μm or more, thereby allowing the foregoing effects synergistically. The mechanical strength can be thus remarkably enhanced. Setting the width of void 14 at which the cumulative distribution stands at 95% to 4 μm or more suppresses metal magnetic particles 12 to touch each other. As a result, metal magnetic particles 12 are effectively insulated from each other, and the eddy-current loss can be reduced.

The preferable width of void 14 corresponding to the cumulative distribution of 50% is 2 μm or less, and the preferable width of void 14 corresponding to the cumulative distribution of 95% is 5 μm or greater, and more preferable one is 6 μm or greater. It is preferable to set the width of void 14 corresponding to the cumulative distribution of 95% to 15 μm or less in order to prevent a decrease in the mechanical strength of a molded body (compact) and a decrease in handling properties of the compact after the heat treatment and before the impregnation.

A method for obtaining the void distribution discussed above is not limited to a specific way; however the following method is recommendable. First of all, a first polymer having the structure below is prepared: it has three or more side chains each of which is formed of carbon atoms or silicon atoms in the quantity of 7 atoms to 11 atoms, inclusive, and has two or less side chains each of which is formed of carbon atoms or silicon atoms in the quantity of 12 atoms or more. In other words, the first polymer includes three or more side chains each formed of carbon atoms or silicon atoms in the quantity of 7 atoms to 11 atoms, inclusive, and yet the first polymer does not include a side chain formed of carbon atoms or silicon atoms in the quantity of 12 atoms or more, or includes a side chain or two side chains of this type. On the other hand, a second polymer having the structure below is prepared: it has two or less side chains each of which is formed of carbon atoms or silicon atoms in the quantity of 7 atoms to 11 atoms, inclusive, or it has three or more side chains each of which is formed of carbon atoms or silicon atoms in the quantity of 12 atoms or more. In other words, the second polymer does not include a side chain formed of carbon atoms or silicon atoms in the quantity of 7 atoms to 11 atoms, inclusive, or includes a side chain or two side chains of this type. The second polymer also includes three or more side chains each of which is formed of carbon atoms or silicon atoms in the quantity of 12 atoms or more. These first polymer and second polymer are added to the metal magnetic powder.

In the first polymer, the side chains each containing the carbon atoms or silicon atoms in the quantity of 7 atoms to 11 atoms produce a steric hindrance that prevents main chains of molecules of the first polymer from approaching each other, so that the main chains are not likely to aggregate or entangle each other. The polymer molecules thus can be fluid with ease, and the first polymer can be easily transformed when it is pressurized. Thus, adding the first polymer to the metal magnetic powder as a molding assistant agent facilitates the filling of metal magnetic particles 12.

The second polymer on the other hand satisfies the first condition or the second condition below. The first condition is that the second polymer contains two or less side chains each of which is formed of carbon atoms or silicon atoms in the quantity of 7 atoms to 11 atoms, inclusive. The second condition is that the second polymer contains three or more side chains each of which is formed of carbon atoms or silicon atoms in the quantity of 12 atoms or more.

In the case of satisfying the first condition, the steric hindrance caused by the side chains is so small that the main chains are not prevented sufficiently from approaching each other. The adjacent main chains thus tend to aggregate or entangle each other, so that the polymer molecules is less fluid. In the case of satisfying the second condition, long side-chains entangle each other, so that the polymer molecules are prevented from being fluid. The second polymer is poorer in transformative capability than the first polymer. Thus, adding second polymer to the metal magnetic powder as a molding assistant agent increases an amount of the voids among metal magnetic particles 12.

In the case of satisfying the first condition, the number of side chains each of which is formed of carbon atoms or silicon atoms in the quantity of 12 atoms or more is not limited. In the case of satisfying the second condition, the number of side chains each of which is formed of carbon atoms or silicon atoms in the quantity of 7 to 11 atoms is not limited likewise.

According to the above discussed effect, compositely adding the first polymer and the second polymer to the metal magnetic powder allows forming the voids in a desirable distribution among metal magnetic particles 12.

A weight ratio of the first polymer with respect to a total weight of the first and the second polymers preferably falls into a range approx. from 10% to 90%. If this ratio falls in less than 10%, the filling factor of metal magnetic particles 12 is lowered, and as a result, it is difficult to set the width of void 14 at which the cumulative distribution stands at 50% equal to or less than 3 μm. If this ratio exceeds 90%, metal magnetic particles 12 are facilitated to fill, and as a result, it is difficult to set the width of void 14 at which the cumulative distribution stands at 95% equal to or greater than 4 μm.

The first and the second polymers include the side chains as mentioned above and main chains to which the side chains are bound. These polymers sometimes contain unavoidable impurities which are molecules having different numbers of carbon atoms or silicon atoms in side chains or a different number of side chains. Although the unavoidable impurities are contained, when the number of molecules of the impurities with respect to the total number of all of the polymer molecules falls within a range of 30% or less, these polymers can produce the advantages discussed above.

The voids among metal magnetic particles 12 are evaluated by using a sectional image of composite magnetic body 10 or the compact before composite insulating resin 16 is impregnated into the compact. When composite magnetic body 10 is used for this evaluation, a part in which neither metal magnetic particles 12 nor insulating resin 16 and a part in which insulating resin 16 is impregnated can be counted as voids 14.

In other words, a sectional image of any cross section of composite magnetic body 10 is taken with an optical microscope or an electronic microscope, and a first group of straight lines is disposed at any point on the sectional image. The first group of straight lines is formed of straight lines parallel to each other and placed at equal intervals of 30 μm. Then a second group of straight lines is disposed at any point on the sectional image. This second group is formed of straight lines parallel to each other, placed at equal intervals of 30 μm, and crosses the first group at right angles. Next, any straight line is selected from the first group and the second group. The selected line crosses the contour of metal magnetic particles 12 on the sectional image, and all the crossing points are extracted.

Line-segments are found on the selected line and have ends at crossing points between the selected lines and the contour of metal magnetic particles 12, and among these line-segments, ones in an image area where no metal magnetic particle 12 exists are extracted. The lengths of these extracted line-segments are recorded as the widths of voids 14 on the selected line. On the selected straight line, when contours of adjacent metal magnetic particles 12 are determined that they are in contact with each other, the width of void is recorded as 0 μm. The foregoing measurement is done to other straight lines to find the widths of each void 14 on each straight line. It is not necessarily to evaluate the widths of voids 14 of all the straight lines on the sectional image. Finding the widths of voids 14 of at least 100 points on the first group of straight lines, and finding the widths of voids 14 of at least 100 points on the second group of straight lines will allow finding the distribution of the widths of voids 14 among metal magnetic particles 12.

Figure 2:
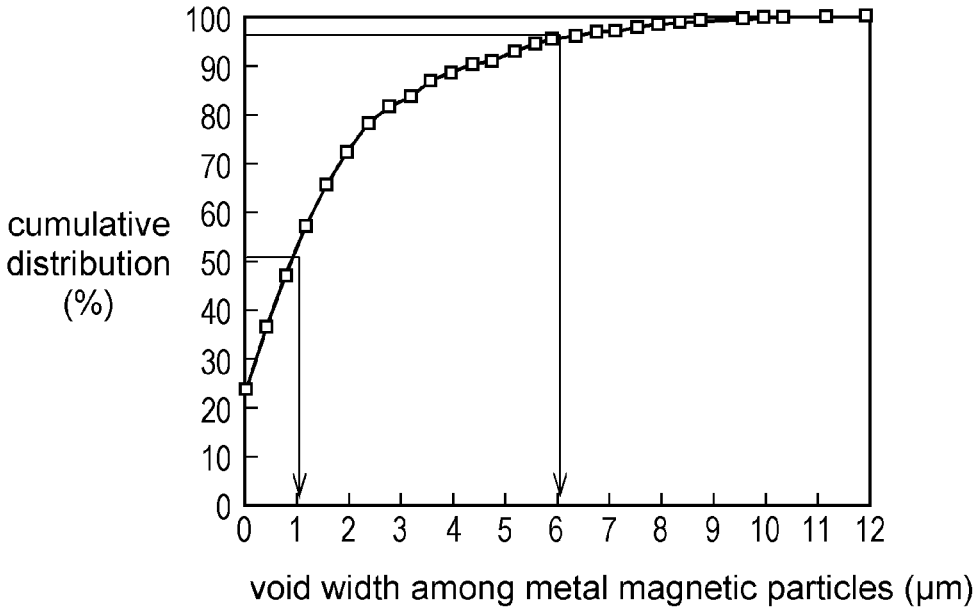
FIG. 2 schematic diagram showing a cumulative distribution of voids in the composite magnetic body in accordance with the first embodiment of the present invention.

The widths of voids 14 thus found are plotted to draw a cumulative distribution curve. FIG. 2 schematically shows the cumulative distribution of voids 14 of composite magnetic body 10. Use of FIG. 2 allows finding a void width at which the cumulative distribution stands at 50% as well as finding a void width at which the cumulative distribution stands at 95%. To avoid adverse influence of non-uniformity of samples, one sample needs three sectional photos viewed from three different field-of-views. The void widths at which cumulative distribution stands at 50% and 95% are thus found. An average of the void widths at which cumulative distribution stands at 50% and 95% is respectively found, and these averages are used as the void distribution of each of target samples.

A method for manufacturing composite magnetic body 10 is demonstrated hereinafter. First of all, it is preferable that an insulator is added to the metal magnetic powder in order to insulate each of metal magnetic particles from each other. A material for the insulator is not limited to a specific one; however, the materials discussed previously can be used. Instead of employing an insulator, an oxide film or a phosphate film can be formed on surfaces of metal magnetic particles 12 in order to insulate each of metal magnetic particles from each other.

Next, the molding assistant agent is mixed with and dispersed into the metal magnetic powder for producing granulated powder. A type of the molding assistant agent is not limited to a specific one; however, the materials discussed previously can be used. A liquid dispersing medium can be added so as to disperse the molding assistant agent in metal magnetic particles 12 with more ease. The insulator and the molding assistant agent can be mixed with the metal magnetic powder at the same time. This mixing and dispersing method is not limited to a specific way. For instance, various ball mills such as a rotary ball mill and planetary ball mill, a V-blender, a planetary mixer or the like can be used. In the case of adding the dispersing medium, the mixture is dried after the mixing in order to remove the dispersing medium. The drying condition is not limited to a specific one as long as the dispersing medium can be vapored. In the case of employing toluene as the dispersing medium, it can be dried at a temperature from 70° C. to 110° C. Natural drying or vacuum drying can be used depending on the type of the dispersing medium. When a mold to be used for pressure molding is filled with this mixture, the mixture can be crushed if it is too bulky to be put thereinto.

Next, the granulated powder undergoes the pressure molding to form a molded body (compact). The granulated powder can be classified to any grain size; however, a grain size of 100-500 μm is preferable for increasing a fluidity of the granulated powder and expecting smoother filling into the mold. The grain size however is not limited to the foregoing grain-size range. A lubricant such as various metal-stearates can be added in order to increase a fluidity of the granulated powder and to expect smoother filling into the mold for making the pressure molding easier. The pressure molding is preferably done at a molding pressure of 6 tons/cm$^2$ or more in this embodiment. Use of the molding pressure around this level allows increasing a density of the compact with a sufficient mechanical strength, high permeability, and low magnetic loss. Considering a service life of the mold and increasing the productivity, it is more preferable to use the molding pressure of 20 tons/cm$^2$ or lower.

In the case of employing a crystalline material as the metal magnetic powder, the heat treatment temperature to be used after the pressure molding preferably falls within the range from 700° C. to 1000° C., inclusive. The heat treatment is provided to remove strains accumulated in the compact after the pressure molding because the strains will cause the magnetic loss to increase in composite magnetic body 10. If the heat treatment is done at a temperature over 1000° C., the insulation among metal magnetic particles 12 lowers, so that the eddy-current loss increases. The heat treatment temperature equal to or lower than 1000° C. is thus preferable. Since amorphous material or metallic glass material prevents coercive force from increasing caused by crystallization, the heat treatment is done preferably at a temperature lower than a crystallizing temperature. In this case the heat treatment temperature is not limited to the foregoing range.

The heat treatment is preferably done in a non-oxidative atmosphere in order to prevent the magnetic properties from lowering caused by oxidizing metal magnetic particles 12. For instance, the heat treatment is preferably done in an inert atmosphere of argon gas, nitride gas, or helium gas. However, an oxidative atmosphere can also produce the foregoing advantages.

In the molded body (compact) after the heat treatment, metal magnetic particles 12 are impregnated with insulating resin 16 for increasing the mechanical strength. A material for insulating resin 16 is not limited to a specific one; however, silicone resin, epoxy resin, or acrylic resin can be used. Instead of insulating resin 16, water glass can be impregnated as an insulator into metal magnetic particles 12. A curing process is performed after the impregnation depending on the material of insulating resin 16. The curing method can be appropriately selected depending on the material of insulating resin 16, for instance, thermal curing, UV curing, natural curing, or chemical-reaction curing is available. A thermoplastic material can be used as insulating resin 16. In this case, this material is heated to be fluid, and is impregnated into the molded body, and then it is cured at a normal temperature or a low temperature. Thermoplastic acrylic resin, polyester resin, liquid crystal polymer are available as the thermoplastic material, which is not limited to these material. The insulator to be impregnated into metal magnetic particles 12 is not limited to a specific material as long as it is fluid at the impregnation and it can be cured after the impregnation.

Specific examples of composite magnetic body 10 are demonstrated hereinafter to show the advantages thereof.

Example 1

Fe—Si alloy powder having an average particle size of 20 μm and produced by a gas-atomization process is used as metal magnetic powder of sample No. 1 through sample No. 41 shown in table 1. Titanium coupling agent is added as an insulator to the metal magnetic powder in the quantity of 0.2 wt %. Furthermore, a first polymer and a second polymer are added thereto in percentages shown in table 1. The first polymer employs a first phenol resin that includes three or more side chains each of which is formed of eight carbon atoms, and yet, excludes a side chain formed of 12 or more than 12 carbon atoms or silicon atoms. The second polymer employs a second phenol resin that excludes a side chain formed of seven or more than seven carbon atoms or silicon atoms. Namely, the second phenol resin has no side chain. The phenol resin in this context refers to a resin of which main chain in its framework is proper to the phenol resin and a side chain is not limited to a specific one.

Each of the samples is formed of the metal magnetic powder, the insulator, and the molding assistant agent. A small quantity of methyl ethyl ketone is added thereto, and these materials are mixed together. The mixture is dried at 80° C. for 30 minutes, then is crushed and classified into grain sizes ranging from 100 to 500 μm so as to prepare granulated powder to be used in molding.

Next, the granulated powder undergoes the pressure molding at a pressure listed in table 1 to form toroidal-shaped cores each having an outer diameter of 14 mm, an inner diameter of 5 mm, and a thickness of 2 mm. These cores undergo a heat treatment at 80° C. for 30 minutes. Then the cores are impregnated with epoxy resin, and cured at 150° C. for 60 minutes. The samples are thus prepared. Magnetic properties of the composite magnetic bodies of these samples are evaluated. To be more specific, magnetic losses are measured by an AC BH-curve measuring instrument at a condition of 110 mT and 120 kHz.

In addition, the each granulated powder mentioned above is molded with the pressure listed in table 1, and plate-like samples are produced. The approx. dimensions of the samples are 18 mm long, 5 mm wide, and 4 mm thick. These plate-like samples undergo the heat treatment at 800° C. for 30 minutes. Then the samples are impregnated with epoxy resin, and cured at 150° C. for 60 minutes. The resultant test pieces undergo a three-point bending test for destructive test, and anti-bending strength S is found based on equation (1) below. During the three-point bending test, the plate-like test piece is fixed to a jig at two end points of which distance is 18 mm in the longitudinal direction, and load is applied to the middle point (a distance from one of the fixed points to the jig is 9 mm) between the end points. A load applying speed is set to 1.5 mm/sec, and the load applied immediately before the plate-like test piece is bent is referred to as breaking load P.

$$S = \frac{3PL}{2t^2w} \tag{1}$$

$P$: breaking load ($N$)

$L$: fulcrum distance of jig (mm)

$t$: thickness of test piece (mm)

$w$: width of test piece (mm)

Each test piece is observed in cross section with an electronic microscope to find a void distribution among the metal magnetic particles. Then a void width at which a cumulative distribution of the void stands at 50% is found, and a void width at which a cumulative distribution of the void stands at 95% is found. The titanium coupling agent used in this example does not function as a molding assistant agent, but functions only as an insulator.

The result of the foregoing evaluation is shown in table 1.

TABLE 1

| Sample No. | Molding pressure (ton · cm$^{-2}$) | Loads of first polymer (wt %) | Loads of second polymer (wt %) | Void width at which cumulative distribution stands at 50% (μm) | Void width at which cumulative distribution stands at 95% (μm) | Anti-bending strength (MPa) | Magnetic loss (kW · m$^{-3}$) |
|---|---|---|---|---|---|---|---|
| 1 | 6 | 0.95 | 0.05 | 2.7 | 3.9 | 41.2 | 1225 |
| 2 | 6 | 1.00 | 0.00 | 2.3 | 3.8 | 42.4 | 1257 |
| 3 | 8 | 0.00 | 1.00 | 3.6 | 11.0 | 42.5 | 915 |
| 4 | 8 | 0.05 | 0.95 | 3.4 | 9.7 | 40.8 | 911 |
| 5 | 8 | 0.10 | 0.90 | 2.9 | 8.8 | 146.5 | 908 |
| 6 | 8 | 0.15 | 0.85 | 2.7 | 8.3 | 144.2 | 924 |
| 7 | 8 | 0.20 | 0.80 | 2.6 | 7.8 | 144 | 938 |
| 8 | 8 | 0.30 | 0.70 | 2.5 | 7.2 | 143.8 | 954 |
| 9 | 8 | 0.70 | 0.30 | 2.2 | 6.3 | 142.3 | 921 |
| 10 | 8 | 0.80 | 0.20 | 1.9 | 6.1 | 165.4 | 889 |
| 11 | 8 | 0.85 | 0.15 | 1.8 | 5.7 | 143.1 | 959 |
| 12 | 8 | 0.90 | 0.10 | 1.8 | 4.3 | 119.8 | 931 |
| 13 | 8 | 0.95 | 0.05 | 1.7 | 3.8 | 43.2 | 1245 |
| 14 | 8 | 1.00 | 0.00 | 1.5 | 3.7 | 41.5 | 1267 |
| 15 | 10 | 0.00 | 1.00 | 3.3 | 7.4 | 45.2 | 962 |
| 16 | 10 | 0.05 | 0.95 | 3.2 | 6.4 | 40.9 | 971 |
| 17 | 10 | 0.10 | 0.90 | 2.8 | 6.2 | 141.3 | 951 |
| 18 | 10 | 0.15 | 0.85 | 2.6 | 6.1 | 142.5 | 953 |
| 19 | 10 | 0.20 | 0.80 | 2.6 | 5.9 | 123 | 964 |
| 20 | 10 | 0.30 | 0.70 | 2.3 | 5.8 | 121.5 | 962 |
| 21 | 10 | 0.70 | 0.30 | 2.2 | 5.4 | 124.1 | 934 |

TABLE 1-continued

| Sample No. | Molding pressure (ton · cm$^{-2}$) | Loads of first polymer (wt %) | Loads of second polymer (wt %) | Void width at which cumulative distribution stands at 50% (μm) | Void width at which cumulative distribution stands at 95% (μm) | Anti-bending strength (MPa) | Magnetic loss (kW · m$^{-3}$) |
|---|---|---|---|---|---|---|---|
| 22 | 10 | 0.80 | 0.20 | 1.9 | 5.2 | 141.5 | 942 |
| 23 | 10 | 0.85 | 0.15 | 1.7 | 4.9 | 120.4 | 931 |
| 24 | 10 | 0.90 | 0.10 | 1.5 | 4.2 | 121.4 | 928 |
| 25 | 10 | 0.95 | 0.05 | 1.4 | 3.7 | 40.1 | 1249 |
| 26 | 10 | 1.00 | 0.00 | 1.1 | 3.7 | 46.5 | 1248 |
| 27 | 12 | 0.00 | 1.00 | 3.2 | 5.9 | 41.2 | 974 |
| 28 | 12 | 0.05 | 0.95 | 3.1 | 5.4 | 43.6 | 978 |
| 29 | 12 | 0.10 | 0.90 | 2.7 | 5.1 | 120.3 | 968 |
| 30 | 12 | 0.15 | 0.85 | 2.6 | 4.9 | 108.4 | 942 |
| 31 | 12 | 0.20 | 0.80 | 2.5 | 4.8 | 111.2 | 941 |
| 32 | 12 | 0.30 | 0.70 | 2.2 | 4.7 | 110.4 | 938 |
| 33 | 12 | 0.70 | 0.30 | 2.1 | 4.4 | 109.5 | 959 |
| 34 | 12 | 0.80 | 0.20 | 1.8 | 4.3 | 120.1 | 935 |
| 35 | 12 | 0.85 | 0.15 | 1.3 | 4.2 | 121.5 | 918 |
| 36 | 12 | 0.90 | 0.10 | 0.9 | 4.1 | 122.8 | 902 |
| 37 | 12 | 0.95 | 0.05 | 0.8 | 3.6 | 46.8 | 1287 |
| 38 | 12 | 1.00 | 0.00 | 0.7 | 3.6 | 41.2 | 1288 |
| 39 | 14 | 0.00 | 1.00 | 3.1 | 4.7 | 40.1 | 981 |
| 40 | 14 | 0.05 | 0.95 | 3.1 | 4.4 | 40.8 | 1054 |
| 41 | 14 | 0.10 | 0.90 | 2.6 | 4.4 | 112.5 | 962 |

Sample No. 5 through Sample No. 12, sample No. 17 through sample No. 24, sample No. 29 through sample No. 36, and sample No. 41 listed in table 1 have the void widths at which the cumulative distribution stands at 50% equal to or smaller than 3 μm, and these samples have the void widths at which the cumulative distribution stands at 95% equal to or greater than 4 μm. These samples thus exhibit high anti-bending strengths and low magnetic losses.

In contrast, sample No. 1 through sample No. 4, sample No. 13 through sample No. 16, sample No. 25 through sample No. 28, and sample No. 37 through sample No. 40 listed in table 1 do not exhibit excellent properties both in the anti-bending strength and the magnetic loss.

In a case where the void width at which the cumulative distribution stands at 95% is equal to or greater than 5.0 μm, the greater anti-bending strength is obtained. For instance, sample No. 29 exhibits a remarkably higher anti-bending strength than sample No. 30 and No. 31. A comparison in the anti-bending strength between sample No. 32 and sample No. 21, and a comparison in the anti-bending strength between sample No. 23 and sample No. 22 also prove that the void width equal to or greater than 5.0 μm achieves the greater anti-bending strength.

Furthermore, the void width equal to or greater than 6.0 μm achieves a further greater anti-bending strength. For instance, sample No. 17 and sample No. 18 exhibit a remarkably higher anti-bending force than sample No. 19. A comparison in the anti-bending strength between sample No. 20 and sample No. 9 as well as between sample No. 11 and sample No. 10 proves that the void width equal to or greater than 6.0 μm achieves a greater anti-bending strength.

In a case where the void width at which the cumulative distribution stands at 50% is equal to or smaller than 2.0 μm, a greater anti-bending strength is obtained.

For instance, sample Nos. 12, 24, and 34 exhibit remarkably higher anti-bending strengths than sample No. 33. A comparison in the anti-bending strength between sample No. 32 and sample No. 23, another comparison in the anti-bending strength between sample No. 21 and sample No. 22, still another comparison in the anti-bending strength between sample No. 20 and sample No. 11, yet another comparison in the anti-bending strength between sample No. 9 and sample No. 10 prove that the void width equal to or smaller than 2.0 μm achieves greater anti-bending strengths.

As discussed previously, it is preferable to set a weight ratio of the first polymer with respect to the total weight of the first and the second polymers within a range from 10% to 90%, inclusive. To be more specific, sample No. 5 through sample No. 12, sample No. 17 through sample No. 24, sample No. 29 through sample No. 36, and sample No. 41 listed in table 1 have the preferable polymer-added ratios.

Sample Nos. 4, 5, 15, 16, 27, 28, 39, and 40 have the weight ratios less than 10%, so that the filling factor of the metal magnetic particles is decreased, and thus it is difficult to set the void width at which the cumulative distribution stands at 50% to equal to or smaller than 3.0 μm. In sample Nos. 1, 2, 13, 14, 25, 26, 37, and 38, the weight ratios of the first polymer exceed 90% so that the filling of the metal magnetic particles is facilitated, and thus it is difficult to set the void width at which the cumulative distribution stands at 95% to equal to or greater than 4 μm.

Note that the loads (added amount) of the molding assistant agent, and molding pressures listed in table 1 are just instances. The void distribution discussed above allows the composite magnetic body to produce the advantages described in the embodiment.

In Example 1, the second polymer employs the second phenol resin formed of 7 or more than 7 carbon atoms or silicon atoms without a side chain. Instead of this phenol resin, a phenol resin including 3 or more side chains each of which is formed of 12 or more than 12 carbon atoms or silicon atoms can be employed with an advantage similar to what is discussed previously.

Example 2

Sample No. 42 through sample No. 45 listed in table 2 employ Fe—Si—Cr—B—C amorphous alloy powder as metal magnetic powder. This amorphous alloy powder is produced by a water-atomization process and has an average particle size of 30 μm. This metal magnetic powder is added with aluminum oxide having an average particle size of 1 μm as an insulator by 0.5 wt %. Further, first and second polymers are mixed therein by 0.8 wt % respectively with respect to the metal magnetic powder together with a small amount of toluene. The first polymer employs a first epoxy resin including 3 or more side chains each of which is formed of 10 carbon atoms, but excluding a side chain formed of 12 or more carbon atoms. The second polymer employs a second epoxy resin including 3 or more side chains each of which is formed of 10 carbon atoms, and also including 3 or more side chains each of which is formed of 13 carbon atoms.

The resultant mixture is dried at 90° C. for 30 minutes, then the dried product is crushed and the resultant particles are classified into grain sizes of 100-500 μm for preparing granulated powder to be used in molding.

The granulated powder is molded at pressures listed in table 2, and plate-like samples similar to those in Example 1 are produced. These samples undergo a heat treatment at 450° C. for 30 minutes, and then the test pieces undergo the three-point bending test for the destructive test that is the same test done in Example 1. An anti-bending strength of each test piece is found by formula (1), and the evaluation result is shown in table 2. That is, the test pieces listed in table 2 are not impregnated with resin.

TABLE 2

| Sample No. | Molding pressure (ton · cm$^{-2}$) | Void width at which cumulative distribution stands at 50% (μm) | Void width at which cumulative distribution stands at (μm) | Anti-bending strength before impregnation (MPa) |
|---|---|---|---|---|
| 42 | 10 | 2.9 | 15.8 | 0.2 |
| 43 | 12 | 2.8 | 15.5 | 0.3 |
| 44 | 14 | 2.7 | 14.2 | 1.7 |
| 45 | 16 | 2.7 | 13.1 | 1.4 |

Sample Nos. 42 and 43 having the void widths at which the cumulative distribution stands at 95% equal to or greater than 15 μm before these samples are impregnated with resin have lower anti-bending strengths than sample Nos. 44 and 45 having the void widths at which the cumulative distribution stands at 95% equal to or smaller than 15 μm. When the mechanical strength of the compact having undergone the heat treatment is lower than 1 MPa, these samples before the impregnation cannot be handled well during the manufacturing steps after the heat treatment, so that the yield rate is decreased. Thus, the void width at which the cumulative distribution stands at 95% is preferably equal to or smaller than 15 μm.

Example 3

Sample Nos. 46 through 100 listed in table 3 employ Fe—Si alloy powder the metal magnetic powder. This alloy powder is produced by the water atomization process, and has an average particle size of 10 μm. This metal magnetic powder is added with silane coupling agent by 0.3 wt % together with a small amount of ethanol. Furthermore, acrylic resin A and acrylic resin B are added by 0.5 wt %, respectively, to the metal magnetic powder. Acrylic resins A and B include 3 or more side chains each of which is formed of carbon atoms of which quantities are listed in table 3, and these resins A and B do not include a side chain formed of 12 or more than 12 carbon atoms or silicon atoms besides the side chains formed of carbon atoms of which quantities are listed in table 3. Table 3 shows which one of acrylic resin A or B corresponds to the first polymer or second polymer. The acrylic resin in this context refers to the resin of which main chain in its framework is proper to the acrylic resin and a side chain is not limited to a specific one.

TABLE 3

| Sample No. | Quantity of carbon atoms of side chain in acrylic resin A | | Quantity of carbon atoms of side chain in acrylic resin B | | Void width at which cumulative distribution stands at 50% (μm) | Void width at which cumulative distribution stands at 95% (μm) | Anti-bending strength (MPa) | Magnetic loss (kW · m$^{-3}$) |
|---|---|---|---|---|---|---|---|---|
| 46 | 5 | 2nd polymer | 1 | 2$^{nd}$ polymer | 3.8 | 5.8 | 61.8 | 1836 |
| 47 | 6 | 2$^{nd}$ polymer | 1 | 2$^{nd}$ polymer | 3.7 | 6.1 | 62.5 | 1872 |
| 48 | 7 | 1$^{st}$ polymer | 1 | 2$^{nd}$ polymer | 2.2 | 4.9 | 114.5 | 1374 |
| 49 | 8 | 1$^{st}$ polymer | 1 | 2$^{nd}$ polymer | 2.1 | 4.7 | 135.8 | 1315 |
| 50 | 9 | 1$^{st}$ polymer | 1 | 2$^{nd}$ polymer | 1.8 | 4.3 | 153.7 | 1297 |
| 51 | 10 | 1$^{st}$ polymer | 1 | 2$^{nd}$ polymer | 1.9 | 4.6 | 133.4 | 1305 |
| 52 | 11 | 1$^{st}$ polymer | 1 | 2$^{nd}$ polymer | 2.2 | 4.9 | 118.3 | 1328 |
| 53 | 12 | 2$^{nd}$ polymer | 1 | 2$^{nd}$ polymer | 4.1 | 5.4 | 68.0 | 1926 |
| 54 | 13 | 2$^{nd}$ polymer | 1 | 2$^{nd}$ polymer | 3.4 | 5.3 | 68.4 | 1884 |
| 55 | 17 | 2$^{nd}$ polymer | 1 | 2$^{nd}$ polymer | 3.8 | 6.1 | 65.5 | 1902 |
| 56 | 6 | 2$^{nd}$ polymer | 5 | 2$^{nd}$ polymer | 3.6 | 5.2 | 61.9 | 1893 |
| 57 | 7 | 1$^{st}$ polymer | 5 | 2$^{nd}$ polymer | 2.1 | 4.9 | 113.3 | 1305 |
| 58 | 8 | 1$^{st}$ polymer | 5 | 2$^{nd}$ polymer | 2.0 | 4.6 | 134.5 | 1298 |
| 59 | 9 | 1$^{st}$ polymer | 5 | 2$^{nd}$ polymer | 1.6 | 4.3 | 144.1 | 1278 |
| 60 | 10 | 1$^{st}$ polymer | 5 | 2$^{nd}$ polymer | 1.8 | 4.4 | 131.6 | 1284 |
| 61 | 11 | 1$^{st}$ polymer | 5 | 2$^{nd}$ polymer | 2.1 | 4.7 | 115.1 | 1305 |
| 62 | 12 | 2$^{nd}$ polymer | 5 | 2$^{nd}$ polymer | 3.4 | 5.1 | 72.8 | 1944 |
| 63 | 13 | 2$^{nd}$ polymer | 5 | 2$^{nd}$ polymer | 3.5 | 5.2 | 68.4 | 1902 |
| 64 | 17 | 2$^{nd}$ polymer | 5 | 2$^{nd}$ polymer | 3.4 | 5.4 | 66.9 | 1854 |
| 65 | 7 | 1$^{st}$ polymer | 6 | 2$^{nd}$ polymer | 2.1 | 4.7 | 111.3 | 1346 |
| 66 | 8 | 1$^{st}$ polymer | 6 | 2$^{nd}$ polymer | 1.9 | 4.5 | 132.3 | 1324 |
| 67 | 9 | 1$^{st}$ polymer | 6 | 2$^{nd}$ polymer | 1.5 | 4.2 | 142.3 | 1308 |

TABLE 3-continued

| Sample No. | Quantity of carbon atoms of side chain in acrylic resin A | | Quantity of carbon atoms of side chain in acrylic resin B | | Void width at which cumulative distribution stands at 50% (μm) | Void width at which cumulative distribution stands at 95% (μm) | Anti-bending strength (MPa) | Magnetic loss ($kW \cdot m^{-3}$) |
|---|---|---|---|---|---|---|---|---|
| 68 | 10 | $1^{st}$ polymer | 6 | $2^{nd}$ polymer | 1.6 | 4.4 | 129.9 | 1311 |
| 69 | 11 | $1^{st}$ polymer | 6 | $2^{nd}$ polymer | 2.1 | 4.6 | 114.8 | 1357 |
| 70 | 12 | $2^{nd}$ polymer | 6 | $2^{nd}$ polymer | 3.1 | 4.8 | 71.3 | 1752 |
| 71 | 13 | $2^{nd}$ polymer | 6 | $2^{nd}$ polymer | 3.8 | 4.9 | 69.4 | 1842 |
| 72 | 17 | $2^{nd}$ polymer | 6 | $2^{nd}$ polymer | 4.1 | 5.1 | 69.1 | 1887 |
| 73 | 7 | $1^{st}$ polymer | 8 | $1^{st}$ polymer | 1.8 | 3.4 | 73.2 | 3097 |
| 74 | 7 | $1^{st}$ polymer | 9 | $1^{st}$ polymer | 1.7 | 2.8 | 74.1 | 3292 |
| 75 | 7 | $1^{st}$ polymer | 10 | $1^{st}$ polymer | 1.7 | 3.1 | 68.9 | 3172 |
| 76 | 7 | $1^{st}$ polymer | 11 | $1^{st}$ polymer | 1.9 | 3.2 | 68.1 | 3142 |
| 77 | 7 | $1^{st}$ polymer | 12 | $2^{nd}$ polymer | 1.7 | 4.3 | 122.0 | 1306 |
| 78 | 7 | $1^{st}$ polymer | 13 | $2^{nd}$ polymer | 1.8 | 4.5 | 123.5 | 1287 |
| 79 | 7 | $1^{st}$ polymer | 17 | $2^{nd}$ polymer | 1.9 | 5.3 | 148.4 | 1274 |
| 80 | 8 | $1^{st}$ polymer | 9 | $1^{st}$ polymer | 1.7 | 2.7 | 73.2 | 3145 |
| 81 | 8 | $1^{st}$ polymer | 10 | $1^{st}$ polymer | 1.6 | 2.8 | 74.5 | 3226 |
| 82 | 8 | $1^{st}$ polymer | 11 | $1^{st}$ polymer | 1.6 | 3.1 | 76.8 | 3214 |
| 83 | 8 | $1^{st}$ polymer | 12 | $2^{nd}$ polymer | 1.7 | 4.4 | 126.4 | 1294 |
| 84 | 8 | $1^{st}$ polymer | 13 | $2^{nd}$ polymer | 1.6 | 4.3 | 130.7 | 1264 |
| 85 | 8 | $1^{st}$ polymer | 17 | $2^{nd}$ polymer | 1.8 | 4.7 | 133.9 | 1253 |
| 86 | 9 | $1^{st}$ polymer | 10 | $1^{st}$ polymer | 1.4 | 2.5 | 67.4 | 3538 |
| 87 | 9 | $1^{st}$ polymer | 11 | $1^{st}$ polymer | 1.4 | 2.7 | 71.8 | 3451 |
| 88 | 9 | $1^{st}$ polymer | 12 | $2^{nd}$ polymer | 1.2 | 4.1 | 133.8 | 1288 |
| 89 | 9 | $1^{st}$ polymer | 13 | $2^{nd}$ polymer | 1.3 | 4.4 | 138.7 | 1267 |
| 90 | 9 | $1^{st}$ polymer | 17 | $2^{nd}$ polymer | 1.3 | 5.1 | 153.5 | 1247 |
| 91 | 10 | $1^{st}$ polymer | 11 | $1^{st}$ polymer | 1.5 | 3.1 | 66.1 | 3538 |
| 92 | 10 | $1^{st}$ polymer | 12 | $2^{nd}$ polymer | 1.5 | 4.2 | 132.6 | 1315 |
| 93 | 10 | $1^{st}$ polymer | 13 | $2^{nd}$ polymer | 1.4 | 4.5 | 134.2 | 1324 |
| 94 | 10 | $1^{st}$ polymer | 17 | $2^{nd}$ polymer | 1.6 | 5.6 | 148.3 | 1331 |
| 95 | 11 | $1^{st}$ polymer | 12 | $2^{nd}$ polymer | 2.4 | 4.6 | 118.4 | 1428 |
| 96 | 11 | $1^{st}$ polymer | 13 | $2^{nd}$ polymer | 2.3 | 4.8 | 121.3 | 1429 |
| 97 | 11 | $1^{st}$ polymer | 17 | $2^{nd}$ polymer | 2.2 | 5.1 | 138.4 | 1435 |
| 98 | 12 | $2^{nd}$ polymer | 13 | $2^{nd}$ polymer | 3.8 | 6.8 | 61.5 | 1923 |
| 99 | 12 | $2^{nd}$ polymer | 17 | $2^{nd}$ polymer | 3.6 | 6.4 | 62.6 | 1836 |
| 100 | 13 | $2^{nd}$ polymer | 17 | $2^{nd}$ polymer | 3.8 | 5.9 | 61.7 | 1791 |

Each sample is formed by mixing the metal magnetic powder, insulator, molding assistant agent, and a small amount of toluene together, and the resultant mixture is dried at 100° C. for 30 minutes, and then the dried product is crushed and the resultant particles are classified into particle sizes of 100-500 μm for preparing granulated powder to be used in molding.

The granulated powder then undergoes the pressure molding at the pressure of 12 ton/cm$^2$ to be toroidal-shaped cores each having an outer diameter of 14 mm, an inner diameter of 10 mm, and a thickness of 2 mm. These cores undergo a heat treatment at 900° C. for 30 minutes. Then the cores are impregnated with thermosetting acrylic resin, and cured at 130° C. for 60 minutes. The samples are thus prepared. The samples are used for measuring magnetic losses likewise in Example 1.

In addition, the granulated powder undergoes the pressure molding at a pressure of 12 tons/cm$^2$, thereby forming plate-like samples of which approx. dimensions are 18 mm long, 5 mm wide, and 4 mm thick. These plate-like samples undergo the heat treatment at 900° C. for 30 minutes, then the samples are impregnated with thermosetting acrylic resin, and cured at 130° C. for 60 minutes. The test pieces thus prepared undergo the three-point bending test for the destructive test that is the same test done in Example 1. An anti-bending strength of each test piece is found by formula (1). In this example, the silane coupling agent does not function as a molding assistant agent, but functions only as an insulator.

Sample No. 48 through sample No. 52, sample No. 57 through sample No. 61, sample No. 65 through sample No. 69, sample No. 77 through sample No. 79, sample No. 83 through sample No. 85, sample No. 88 through sample No. 90, and sample No. 92 through sample No. 97 have void widths at which the cumulative distributions stand at 50% equal to or smaller than 3 μm, and void widths at which the cumulative distributions stand at 95% equal to or greater than 4 μm. These samples thus exhibit high anti-bending strengths and low magnetic losses. These samples employ a first polymer as either one of acrylic resin A or acrylic resin B, and a second polymer as the remaining one of acrylic resin A or acrylic resin B. The first polymer includes 3 or more side chains each of which is formed of carbon atoms in the quantity of 7 to 11, inclusive, and the second polymer includes 3 or more side chains each of which is formed of carbon atoms in the quantity of 6 or less, or includes 2 or less side chains each of which is formed of 12 or more carbon atoms.

On the other hand, sample Nos. 46 and 47, sample No. 53 through sample No. 56, sample No. 62 through sample No. 64, sample No. 70 through sample No. 76, sample No. 80 through sample No. 82, sample Nos. 86, 87, and 91, and sample No. 98 through sample No. 100 do not exhibit excellent anti-bending strengths or magnetic losses. In these samples, a specific cumulative distributions cannot be observed even when the following acrylic resins are mixed in these samples: two types of acrylic resins having side chains each formed of carbon atoms in the quantity of 7 to 11, inclusive are mixed in these samples, or two types of acrylic resins having side chains each formed of carbon atoms in the quantity of 6 or less, or 12 or more are mixed in these samples. To be more specific, in the specific cumulative distributions, the void widths at which the cumulative distributions stand at 50% is equal to or smaller than 3 μm and void widths at which the cumulative distributions stand at 95% is equal to or greater than 4 μm.

Sample Nos. 46, 47, sample No. 53 through sample No. 56, sample No. 62 through sample No. 64, sample No. 70 through sample No. 72, and sample No. 98 through sample No. 100 exhibit greater magnetic losses because the voids among the metal magnetic particles extend wider overall in each of these samples, thereby incurring greater hysteresis losses.

Sample No. 73 through sample No. 76, sample No. 80 through sample No. 82, and sample Nos. 86, 87, and 91 exhibit greater magnetic losses because the voids among the metal magnetic particles are narrow overall in entire each of these samples, so that the particles touch with each other more frequently, which lowers the insulations and increases the eddy-current losses.

Example 4

Sample No. 101 through sample No. 125 listed in table 4 employ Fe—Al—Si alloy powder as metal magnetic powder. This powder is produced by the water atomization process and has an average particle size of 10 μm. This metal magnetic powder is mixed with silicone resin as an insulator by 0.2 wt % and a small amount of toluene. The silicone resin contains 3 or more side chains each of which is formed of 6 carbon atoms, and 3 or more side chains each formed of one carbon atom. Then the resins listed in table 4 are added as first and second polymers by 0.7 wt %, respectively, to the metal magnetic powder, thereby producing mixtures.

Sample No. 126 through sample No. 135 listed in table 4 employ Fe—Al—Si alloy powder as metal magnetic powder. This powder is produced by the water atomization process and having an average particle size of 10 μm. This metal magnetic powder is mixed with silicone resin as an insulator by 0.2 wt % and a small amount of toluene. This silicone resin is the same one as discussed previously. Then a first polymer or a second polymer listed in table 4 is added by 1.4 wt % to the metal magnetic powder, thereby producing mixtures. The first polymer contains 3 or more side chains each of which is formed of 9 carbon atoms, and yet does not contain a side chain formed of 12 or more carbon atoms. The second polymer contains one side chain formed of 10 carbon atoms and 3 or more side chains each of which is formed of 13 carbon atoms.

Each of these mixtures, namely, each of sample No. 101 through sample No. 135 is dried at 90° C. for 30 minutes. The dried products are crushed and the resultant particles are classified into grain sizes of 100-500 μm so as to prepare granulated powder to be used in molding.

The granulated powder then undergoes the pressure molding at the pressure of 12 tons/cm$^2$ to form toroidal-shaped cores each having an outer diameter of 14 mm, an inner diameter of 10 mm, and a thickness of 2 mm. These cores undergo a heat treatment at 700° C. for 30 minutes. Then the cores are impregnated with thermosetting acrylic resin, and cured at 130° C. for 60 minutes. The samples thus prepared are used for measuring magnetic losses likewise in Example 1.

The granulated powder undergoes the pressure molding at a pressure of 12 tons/cm$^2$, thereby forming plate-like samples of which approx. dimensions are 18 mm long, 5 mm wide, and 4 mm thick. These plate-like samples undergo the heat treatment at 700° C. for 30 minutes, then the samples are impregnated with thermosetting acrylic resin, and cured at 130° C. for 60 minutes. The test pieces thus prepared undergo the three-point bending test for the destructive test that is the same test done in Example 1. An anti-bending strength of each sample is found by formula (1). In this example, the silicone resin have the functions as an insulator and also a molding assistant agent, and it performs both of the insulator and the molding assistant agent in this example.

TABLE 4

| Sample No. | First polymer | Second polymer | Void width at which cumulative distribution stands at 50% (μm) | Void width at which cumulative distribution stands at 95% (μm) | Anti-bending strength (MPa) | Magnetic loss (kW · m$^{-3}$) |
|---|---|---|---|---|---|---|
| 101 | silicone resin | silicone resin | 1.8 | 5.4 | 103.6 | 493 |
| 102 | silicone resin | epoxy resin | 1.9 | 5.3 | 104.2 | 478 |
| 103 | silicone resin | acrylic resin | 1.7 | 5.8 | 114.1 | 439 |
| 104 | silicone resin | phenolic resin | 1.9 | 5.7 | 104.1 | 423 |
| 105 | silicone resin | butyral resin | 1.7 | 5.3 | 109.3 | 427 |
| 106 | epoxy resin | silicone resin | 1.8 | 5.2 | 108.3 | 418 |
| 107 | epoxy resin | epoxy resin | 1.5 | 5.1 | 109.4 | 425 |
| 108 | epoxy resin | acrylic resin | 1.3 | 5.1 | 118.1 | 435 |
| 109 | epoxy resin | phenolic resin | 1.7 | 5.4 | 110.4 | 417 |
| 110 | epoxy resin | butyral resin | 1.5 | 5.5 | 109.6 | 458 |
| 111 | acrylic resin | silicone resin | 1.9 | 5.4 | 121.2 | 416 |
| 112 | acrylic resin | epoxy resin | 1.8 | 5.9 | 124.6 | 448 |
| 113 | acrylic resin | acrylic resin | 1.3 | 5.4 | 154.8 | 426 |
| 114 | acrylic resin | phenolic resin | 1.5 | 5.3 | 123.3 | 418 |
| 115 | acrylic resin | butyral resin | 1.6 | 5.3 | 123.4 | 429 |
| 116 | phenolic resin | silicone resin | 1.9 | 5.7 | 108.1 | 438 |
| 117 | phenolic resin | epoxy resin | 1.8 | 5.1 | 109.1 | 475 |
| 118 | phenolic resin | acrylic resin | 1.7 | 5.4 | 114.3 | 451 |
| 119 | phenolic resin | phenolic resin | 1.8 | 5.5 | 104.6 | 433 |
| 120 | phenolic resin | butyral resin | 1.8 | 5.6 | 109.4 | 428 |
| 121 | butyral resin | silicone resin | 1.6 | 5.4 | 104.3 | 439 |
| 122 | butyral resin | epoxy resin | 1.5 | 5.8 | 108.3 | 468 |

TABLE 4-continued

| Sample No. | First polymer | Second polymer | Void width at which cumulative distribution stands at 50% (μm) | Void width at which cumulative distribution stands at 95% (μm) | Anti-bending strength (MPa) | Magnetic loss (kW · m$^{-3}$) |
|---|---|---|---|---|---|---|
| 123 | butyral resin | acrylic resin | 1.6 | 5.9 | 119.1 | 438 |
| 124 | butyral resin | phenolic resin | 1.9 | 5.4 | 105.9 | 447 |
| 125 | butyral resin | butyral resin | 1.7 | 5.7 | 107.4 | 497 |
| 126 | silicone resin | — | 1.3 | 2.8 | 43.5 | 864 |
| 127 | epoxy resin | — | 1.2 | 2.7 | 45.6 | 867 |
| 128 | acrylic resin | — | 1.1 | 2.6 | 56.3 | 893 |
| 129 | phenolic resin | — | 1.3 | 2.6 | 48.4 | 843 |
| 130 | butyral resin | — | 1.2 | 2.8 | 46.9 | 849 |
| 131 | — | silicone resin | 3.5 | 6.9 | 44.5 | 641 |
| 132 | — | epoxy resin | 3.8 | 6.3 | 45.8 | 638 |
| 133 | — | acrylic resin | 4.2 | 6.8 | 53.4 | 679 |
| 134 | — | phenolic resin | 4.1 | 5.9 | 46.4 | 618 |
| 135 | — | butyral resin | 3.9 | 6.4 | 45.7 | 635 |

Sample No. 101 through sample No. 125 employ both of the first polymer and the second polymer. Each of these polymers is one of silicone resin, epoxy resin, acrylic resin, phenolic resin, and butyral resin listed in table 4. In any combination discussed above, the first polymer contains 3 or more side chains each of which is formed of 9 carbon atoms, and does not contain a side chain formed of 12 or more carbon atoms. The second polymer contains one side chain formed of 10 carbon atoms, and 3 or more side chains each of which is formed of 13 carbon atoms. In the combinations of the foregoing first polymers and the second polymers, the void distribution satisfies the condition in which void widths at which the cumulative distribution stands at 50% are equal to or smaller than 3 μm and void widths at which the cumulative distribution stands at 95% are equal to or greater than 4 μm. These samples exhibit high anti-bending strengths and low magnetic losses.

Sample No. 126 through sample No. 135 on the other hand are added with either one of the first polymer or the second polymer. In these samples, the void distribution does not satisfy the condition in which the void widths at which the cumulative distribution stands at 50% are equal to or smaller than 3 μm and void widths at which the cumulative distribution stands at 95% are equal to or greater than 4 μm. These samples thus exhibit low mechanical strengths and high magnetic losses.

Sample Nos. 103, 108, 111 through 115, 118, and 123 that employ acrylic resin exhibit especially higher mechanical strengths. Sample No. 113, including the first and the second polymers both of which employ acrylic resin, exhibits remarkably high mechanical strength. Acrylic resin is easily decomposed during the heat treatment, and leaves little residue, so that the voids among the metal magnetic particles are seldom blocked by the residue. Use of the acrylic resin allows the impregnated resin to permeate the compact more efficiently. As a result, it is considered that the effect discussed above is obtained.

Example 5

Sample No. 136 through sample No. 148 listed in table 5 employ Fe—Ni alloy powder as metal magnetic powder. This powder is produced by the water atomization process and has an average particle size of 10 μm. A silane coupling agent is added to this metal magnetic powder as an insulator in the quantities listed in table 5. Furthermore, a first epoxy resin and a second epoxy resin are added thereto as a first polymer and a second polymer at a weight ratio of 1:1. The first epoxy resin contains 3 or more side chains each of which is formed of 11 carbon atoms, and yet, it does not contain a side chain formed of carbon atoms or silicon atoms in the quantity of 12 atoms or more. The second epoxy resin contains 3 or more side chains each of which is formed of 17 carbon atoms. A total amount of the first and second epoxy resins is added to the metal magnetic powder at the ratios listed in table 5.

Each of the mixtures, namely, each of sample No. 136 through sample No. 148, is dried at 110° C. for 60 minutes. Then the dried products are crushed and the resultant particles are classified into grain sizes of 100-500 μm so as to prepare granulated powder to be used in molding.

Next, the granulated powder undergoes the pressure molding at the pressure of 8 tons/cm$^2$ to form toroidal-shaped cores each having an outer diameter of 14 mm, an inner diameter of 10 mm, and a thickness of 2 mm. These cores undergo a heat treatment at 800° C. for 30 minutes. Then the cores are impregnated with epoxy resin, and cured at 150° C. for 60 minutes. The samples thus prepared are used for measuring magnetic losses likewise in Example 1.

In addition, an LCR meter is used in the condition of 120 kHz and a applied magnetic field of 52 Oe so as to measure an inductance value, and then a relative permeability is derived from the inductance value.

Furthermore, the granulated powder undergoes the pressure molding at a pressure of 8 tons/cm$^2$, thereby forming plate-like samples of which dimensions are approx. 18 mm long, 5 mm wide, and 4 mm thick. These plate-like samples undergo the heat treatment at 800° C. for 30 minutes, then the samples are impregnated with epoxy resin, and cured at 150° C. for 60 minutes. The test pieces thus prepared undergo the three-point bending test for the destructive test that is the same test done in Example 1. An anti-bending strength of each sample is found by formula (1). In this example, the silane coupling agent does not function as a molding assistant agent, but functions only as an insulator.

TABLE 5

| Sample No.. | Loads of silane coupling agent (wt %) | Total loads of epoxy resin (wt %) | Total loads (wt %) | Void width at which cumulative distribution stands at 50% (μm) | Void width at which cumulative distribution stands at 95% (μm) | Anti-bending strength (MPa) | Magnetic loss (kW · m$^{-3}$) | Relative permeability |
|---|---|---|---|---|---|---|---|---|
| 136 | 0.00 | 6.00 | 6.00 | 1.3 | 4.2 | 125.4 | 1024 | 60 |
| 137 | 0.01 | 6.00 | 6.01 | 1.4 | 4.3 | 129.4 | 734 | 60 |
| 138 | 0.10 | 6.00 | 6.10 | 1.6 | 4.3 | 128.3 | 706 | 60 |
| 139 | 1.00 | 6.00 | 7.00 | 1.6 | 4.4 | 126.5 | 703 | 59 |
| 140 | 3.00 | 6.00 | 8.00 | 1.9 | 4.4 | 122.8 | 705 | 58 |
| 141 | 4.00 | 6.00 | 10.00 | 2.5 | 4.8 | 109.4 | 738 | 58 |
| 142 | 5.00 | 6.00 | 11.00 | 2.9 | 7.9 | 113.4 | 724 | 47 |
| 143 | 0.00 | 8.00 | 8.00 | 1.7 | 4.5 | 122.4 | 1054 | 58 |
| 144 | 0.01 | 8.00 | 8.01 | 1.7 | 4.6 | 122.8 | 716 | 58 |
| 145 | 0.10 | 8.00 | 8.10 | 1.8 | 4.5 | 123.8 | 708 | 57 |
| 146 | 1.00 | 8.00 | 9.00 | 1.9 | 4.7 | 118.4 | 701 | 56 |
| 147 | 2.00 | 8.00 | 10.00 | 2.5 | 4.8 | 108.6 | 743 | 56 |
| 148 | 3.00 | 8.00 | 11.00 | 2.8 | 8.1 | 114.3 | 758 | 47 |

As table 5 shows, sample No. 137 through sample No. 142, and sample No. 144 through sample No. 148, to which the silane coupling agent is added by 0.01 wt % or more, exhibit especially lower magnetic losses. It is considered because the silane coupling agent functions as the insulator effectively. These results thus proves that the insulator is preferably added to the metal magnetic particles. Sample Nos. 142 and 148, to which the silane coupling agent and epoxy resin are added in the total amount of over 10 wt %, exhibit a lower relative permeability. It is considered because excessive amounts of the silane coupling agent and the epoxy resin reduce the filling factor of the metal magnetic particles. It is thus concluded that the total amount of the insulator and the molding assistant agent is preferably equal to or less than 10 wt %.

Example 6

Sample No. 149 through sample No. 154 listed in table 6 employ Fe—Ni alloy powder as metal magnetic powder. This powder is produced by the water atomization process and has an average particle size of 12 μm. A silane coupling agent is added to this metal magnetic powder as an insulator by 0.3 wt %. Furthermore, a first butyral resin and a second butyral resin are added thereto as a first polymer and a second polymer at a weight ratio of 1 wt % with respect to the metal magnetic powder, respectively, together with a small amount of ethanol. The first butyral resin contains 3 or more side chains each of which is formed of 11 carbon atoms, and 2 side chains each of which is formed of 15 carbon atoms. The second butyral resin contains 3 or more side chains each of which is formed of 15 carbon atoms.

Each of the mixtures, namely sample No. 149 through sample No. 154, is dried at 100° C. for 30 minutes. The dried products are crushed and the resultant particles are classified into grain sizes of 100-500 μm so as to prepare granulated powder to be used in molding.

Next, the granulated powder undergoes the pressure molding at the pressures listed in table 6 to form toroidal-shaped cores each having an outer diameter of 14 mm, an inner diameter of 10 mm, and a thickness of 2 mm. These cores undergo a heat treatment at 800° C. for 60 minutes. Then the cores are impregnated with silicone resin, and cured at 150° C. for 90 minutes. The samples thus prepared are used for measuring magnetic losses likewise in Example 1.

In addition, the granulated powder undergoes the pressure molding at pressures listed in table 6, thereby forming plate-like samples of which dimensions are approx. 18 mm long, 5 mm wide, and 4 mm thick. These plate-like samples undergo the heat treatment at 800° C. for 60 minutes, then the samples are impregnated with silicone resin, and cured at 150° C. for 90 minutes. The test pieces thus prepared undergo the three-point bending test for the destructive test that is the same test done in Example 1. An anti-bending strength of each sample is found by formula (1). In this example, the silane coupling agent does not function as a molding assistant agent, but it functions only as an insulator.

TABLE 6

| Sample No. | Pressure in molding (ton · cm$^{-2}$) | Anti-bending strength (MPa) | Magnetic loss (kW · m$^{-3}$) |
|---|---|---|---|
| 149 | 5 | 55.1 | 1038 |
| 150 | 6 | 123.9 | 892 |
| 151 | 7 | 122.3 | 885 |
| 152 | 8 | 124.0 | 867 |
| 153 | 9 | 125.9 | 854 |
| 154 | 10 | 128.2 | 829 |

As table 6 shows, sample No. 150 through sample No. 154, having undergone the molding pressures equal to or greater than 6 tons/cm$^2$, exhibit remarkably greater anti-bending strengths and the smaller magnetic losses than sample No. 149. These results thus proves that the molding pressure is preferably equal to or greater than 6 tons/cm$^2$ to enhance the mechanical strength and reduce the magnetic loss.

Example 7

Sample Nos. 155 through 160 listed in table 7 employ Fe—Si—Cr alloy powder as metal magnetic powder. This powder is produced by a gas-atomization process and has an average particle size of 30 μm. This metal magnetic powder is added with a first silicone resin and a second silicone resin as first and second polymers by 1.5 wt %, respectively, with respect to the metal magnetic powder together with a small amount of toluene. The first silicone resin contains 3 or more side chains each of which is formed of 10 silicon atoms, but excludes a side chain formed of 12 or more carbon atoms or silicon atoms. The second silicone resin contains 3 or more side chains each of which is formed of 16 silicon atoms, and yet excludes a side chain formed of 7 to 11, inclusive, carbon atoms or silicon atoms.

Each of these mixtures, namely, each of sample No. 155 through sample No. 160 is dried at 90° C. for 90 minutes, then the dried product is crushed and the resultant particles are classified into grain sizes of 100-500 μm so as to prepare granulated powder to be used in molding.

Next, the granulated powder undergoes the pressure molding at the pressure of 10 tons/cm$^2$ to be toroidal-shaped cores each having an outer diameter of 14 mm, an inner diameter of 10 mm, and a thickness of 2 mm. These cores undergo a heat treatment at the temperatures listed in table 7 for 60 minutes. Then the cores are impregnated with thermosetting acrylic resin, and cured at 140° C. for 60 minutes. The samples thus prepared are used for measuring magnetic losses likewise in Example 1.

In addition, the granulated powder is molded at pressure of 10 tons/cm$^2$, and plate-like samples of which approx. dimensions are 18 mm long, 5 mm wide, and 4 mm thick. These samples undergo a heat treatment at the temperatures listed in table 7 for 60 minutes, then are impregnated with thermosetting acrylic resin, and cured at 140° C. for 60 minutes. The test pieces thus prepared undergo the three-point bending test for the destructive test that is the same test done in Example 1. An anti-bending strength of each sample is found by formula (1). The silicone resin employed in this example have the functions as an insulator and also a molding assistant agent, and it performs both of these functions in this example.

TABLE 7

| Sample No. | Heat-treatment temperature (° C.) | Anti-bending strength (MPa) | Magnetic loss (kW · m$^{-3}$) |
|---|---|---|---|
| 155 | 650 | 112.1 | 1532 |
| 156 | 700 | 115.2 | 896 |
| 157 | 800 | 117.3 | 753 |
| 158 | 900 | 118.2 | 729 |
| 159 | 1000 | 117.4 | 698 |
| 160 | 1050 | 137.2 | 1789 |

As table 7 shows, sample No. 156 through sample No. 159 exhibit lower magnetic losses than sample Nos. 155 and 160. These results thus prove that the heat treatment is preferably done at a temperature from 700° C. to 1000° C., inclusive, for reducing the magnetic losses while the mechanical strength is maintained.

Second Exemplary Embodiment

Figure 3:
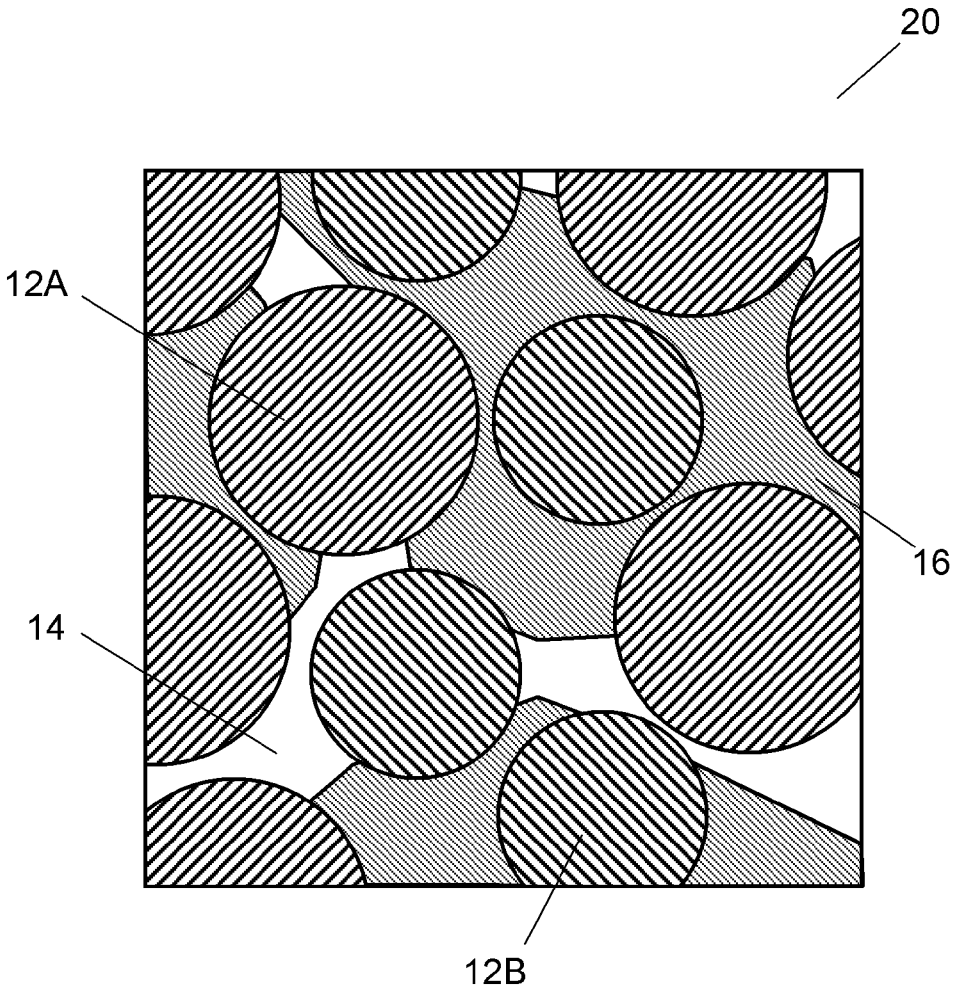
FIG. 3 is a schematic enlarged sectional view of a composite magnetic body in accordance with a second embodiment of the present invention.

FIG. 3 is an enlarged schematic sectional view of composite magnetic body in accordance with the second embodiment of the present invention. Composite magnetic body 20 is different from composite magnetic body 10 in accordance with the first embodiment shown in FIG. 1 in that the metal magnetic powder is formed of first metal magnetic particles 12A and second metal magnetic particles 12B. The mass saturation magnetization of first metal magnetic particles 12A is equal to or smaller than that of second metal magnetic particles 12B, and the average particle size of first metal magnetic particles 12A is equal to or greater than that of second metal magnetic particles 12B.

A relation between first metal magnetic particles 12A and second metal magnetic particles 12B is expressed as follows:

$$\sigma sL \leq \sigma sH \text{ and } DH \leq DL$$

where σsL is the mass saturation magnetization and DL is the average particle size of first metal magnetic particles 12A, and σsH is the mass saturation magnetization and DH is the average particle size of second metal magnetic particles 12B. In particular, it is preferable that the following relations are satisfied:

$$\sigma sL/\sigma sH \leq 0.9, \text{ and } DH/DL \leq 0.5$$

It is effective to improve DC superposition characteristics at the powder magnetic core (i.e. composite magnetic body) for downsizing inductance components. For instance, Unexamined Japanese Patent Publication No. 2000-188214 suggests a method for improving the DC superposition characteristics. According to the method, the powder magnetic core contains permanent magnet powder, an intense magnetic field is applied along a magnetic path of the core, and the permanent magnet powder is magnetized.

However, since this method essentially needs magnetizing the permanent magnet powder, worker-hour in manufacturing is increased, which boosts the product cost. Moreover, since the powder magnetic core itself is magnetized by the magnetization, when other magnetic powders approach to the core, they adsorb magnetically on the powder magnetic core, so that the adsorption causes various failures of the core as a magnetic product. The method also requires a circuit to be mounted so as to applying a DC magnetic field along the opposite direction to the magnetizing direction. This requirement is unfavorable to the manufacturing process.

On the other hand, an initial permeability and a saturation magnetic flux density of the composite magnetic body influence the DC superposition characteristics.

A higher initial permeability will make it easier for the magnetic flux to be saturated. For instance, two types of composite magnetic bodies having the same saturation magnetic flux density are compared with each other, then it is found that the composite magnetic body having higher initial permeability tends to have lower DC superposition characteristics. It is thus concluded that a remarkable rising in the initial permeability is suppressed while the saturation magnetic flux density is increased for improving effectively the DC superposition characteristics.

The initial permeability of magnetic materials is qualitatively proportional to a square of saturation magnetization, and in the case of the material being powder, the initial permeability depends on a particle size, namely, a smaller particle size lowers the initial permeability.

An equality in magnetic gaps (i.e. distance between metal magnetic particles) of the powder magnetic core also influences the DC superposition characteristics. If the magnetic gaps are non-uniform, the magnetic fluxes are concentrated on a small magnetic-gap portion (i.e. a portion where metal magnetic particles are densely available), thereby inviting the magnetic saturation with ease. The DC superposition characteristics are thus lowered. It is thus effective for improving the DC superposition characteristics to increase the equality in the magnetic gaps of the powder magnetic core.

Reviewing the points discussed above, the inventors find that the following two items should be controlled to obtain excellent DC superposition characteristics: mass saturation magnetization as (saturation magnetization per unit mass) of the metal magnetic particles forming the metal magnetic powder, and particle size of the powder.

Composite magnetic body 20 is formed by mixing first metal magnetic particles 12A and second metal magnetic particles 12B having a greater mass saturation magnetization than first metal magnetic particles 12A, so that a remarkable increase in the initial permeability of composite magnetic body 20 is suppressed and the DC superposition characteristics can be improved. In particular, Setting the value of $\sigma sL/\sigma sH$ equal to or lower than 0.9 allows to suppress remarkable increase of the initial permeability of the composite magnetic body for improving the DC superposition characteristics.

On top of that, mixing first metal magnetic particles 12A with second metal magnetic particles 12B having particle sizes equal to or smaller than first metal magnetic particles 12A allows improving the equality in magnetic gaps of composite magnetic body 20, so that the DC superposition characteristics can be further improved. In particular, setting the value of DH/DL to equal to or lower than 0.5 allows second metal magnetic particles 12B, which is highly magnetized, to suppress the remarkable increase of the initial permeability of composite magnetic body 20 and to make the magnetic gaps uniform. The resultant equality in the magnetic gaps allows suppressing the magnetic saturation, so that the DC superposition characteristics can be improved.

Second metal magnetic particles 12B are preferably contained in the total metal magnetic powder of composite magnetic body 20 at the ratio from 2 to 30 wt %, inclusive. If the content is smaller than 2 wt %, the additive of second metal magnetic particles 12B, which is highly magnetized, does not work well for improving the DC superposition characteristics. If the content is over 30 wt %, the DC superposition characteristics cannot be improved sufficiently because of a remarkable increment in the initial permeability of composite magnetic body 20. If the content of second metal magnetic particles 12B falls out of the range from 2 to 30 wt %, the equality in magnetic gaps is lowered, so that the DC superposition characteristics cannot be improved sufficiently.

The mass saturation magnetization $\sigma sL$ of first metal magnetic particles 12A is preferably equal to or greater than 70 emu/g. If the mass saturation magnetization $\sigma sL$ of first metal magnetic particles 12A, which is low-magnetized, is smaller than 70 emu/g, the DC superposition characteristics of composite magnetic body 20 are lowered. With regard to a metal magnetic powder having a greater mass saturation magnetization $\sigma s$, Fe—Co based powder of 235 emu/g is a typical example. To satisfy the relation of $\sigma sL/\sigma sH \leq 0.9$, an upper limit of mass saturation magnetization $\sigma sL$ of first metal magnetic particles 12A is approx. 211 emu/g.

Average particle size DL of first metal magnetic particles 12A preferably falls within the range from 2 to 100 μm, inclusive. The average particle size equal to or smaller than 100 μm allows suppressing the eddy-current loss, and the average particle size equal to or greater than 2 μm allows increasing a molded density after the pressure molding, thereby improving the DC superposition characteristics.

The average particle size DL equal to or smaller than 100 μm allows also suppressing a remarkable increase of the initial permeability of first metal magnetic particles 12A, so that a remarkable increase in the initial permeability of composite magnetic body 20 can be also suppressed. As a result, the improvement effect of the DC superposition characteristics can be enhanced. Moreover, setting the average particle size of first metal magnetic particles 12A to equal to or greater than 2 μm allows suppressing a remarkable decrease of the initial permeability. However, in this case, a change in the permeability caused by a DC magnetic field in composite magnetic body 20 becomes greater. With all this fact, the foregoing range is still preferable because a relative permeability becomes greater.

Average particle size DH of second metal magnetic particles 12B is preferably equal to or greater than 0.1 μm, so that the molded density can be increased, thus the improvement effect of the DC superposition characteristics can be enhanced.

The average particle size of the metal magnetic particles is a value to be found by a particle-size distribution measuring method of laser diffraction type. For instance, a diameter of a subject particle showing the same pattern of light-diffraction and light-diffusion as a 10 μm-dismeter ball measures also 10 μm regardless of the shape of the subject particle. The average particle size is measured by a following way: the particle sizes are counted in order of increasing sizes, and when the accumulation reaches 50% of the total, then the particle size is determined as the average.

Constituent elements of metal magnetic powder for composite magnetic body 20 preferably contain at least Fe, for instance, the following crystalline metal magnetic powders can be used: Fe, Fe—Si based, Fe—Si—Cr based, Fe—Ni based, Fe—Ni—Mo based, Fe—Si—Al based, Fe—Co based. Amorphous metal magnetic powders such as Fe based amorphous, Co based amorphous can be also used. The method for manufacturing these metal magnetic powders is not limited to a specific one, and various types of atomization processes or various types of pulverized powders can be employed as described in the first embodiment.

Materials for an insulator to be used in composite magnetic body 20 are not limited to specific ones as long as they lie between multiple metal magnetic particles and insulate the particles from each other. For instance, various coupling agents, resin-based organic or inorganic materials can be used. The coupling agent includes silane-based coupling agent, titanium-based coupling agent, chrome-based coupling agent, and aluminum-based coupling agent. The organic material includes silicone resin, epoxy resin, acrylic resin, butyral resin, and phenol resin. The inorganic material includes aluminum oxide, silicon oxide, titanium oxide, magnesium oxide, boron nitride, aluminum nitride, silicon nitride, mica, talc, and kaolin.

The metal magnetic particles can undergo oxidation up to a degree where the magnetic properties of the particles are not remarkably lowered, to form an oxide film, which serves as the insulator. In the case of employing an inorganic material or the oxide film as the insulator, an organic material is preferably used together from a viewpoint of a strength of the compact after pressure molding in the manufacturing.

In the case of employing an organic material alone, the following materials are preferably used because inorganic elements contained in these organic materials are left as oxide after a heat treatment at a high temperature, and the oxide serves as the function of the insulator: silane-based, titanium-based, chrome-based, or aluminum-based coupling agent, or silicone resin. The insulator to be employed in this embodiment can be thus selected appropriately depending on an application as described in the first embodiment.

An amount of the insulator to be added to composite magnetic body 20 preferably falls within a range from 0.1 part by weight to 6 parts by weight, inclusive with respect to 100 parts by weight of the metal magnetic powder regardless of organic or inorganic material. The amount equal to or greater than 0.1 part by weight allows maintaining the insulation sufficiently between the metal magnetic particles, and the amount equal to or smaller than 6 parts by weight allows increasing the filling factor of the metal magnetic particles in composite magnetic body 20, so that the magnetic properties can be improved.

A method for manufacturing composite magnetic body 20 is demonstrated hereinafter. First of all, first metal magnetic particles 12A, second metal magnetic particles 12B, and the insulator are weighed, and then mixed together to prepare mixed powder.

A mixing order of these materials and a mixing method are not limited to specific ones. For instance, various ball mills such as rotary ball mill and planetary ball mill, V-blender, planetary mixer, kneader or the like can be used.

Next, the mixed powder thus obtained undergoes a pressure molding for producing a compact in a given shape. A method for the pressure molding is not limited to a specific one, and regular methods can be used. A molding pressure preferably falls into the range from 6 tons/cm$^2$ to 20 tons/cm$^2$, inclusive. The molding pressure equal to or greater than 6 tons/cm$^2$ allows increasing the filling factor of the metal magnetic particles, thereby improving the magnetic properties. A molding pressure over 20 tons/cm$^2$ requires a mold in a larger size to be used in order to obtain durable strength at the pressure molding. On top of that, a pressing machine in a larger size is needed for obtaining a sufficient molding pressure. A mold and a pressing machine in larger sizes will lower the productivity and cause an increment in the production cost.

The compact can be formed by an injection molding or a transfer molding using various types of thermoplastic resins or thermosetting resins. Since these molding methods need pressures lower than the pressure used at the pressure molding, composite magnetic body 20 resultantly has a lower density and thus the magnetic properties thereof becomes degraded; however, these methods are effective for manufacturing the compact in a smaller size. As discussed above, the molding methods can be selected appropriately depending on an application.

The compact thus obtained undergoes a heat treatment for releasing process-strains introduced into the metal magnetic particles during the pressure molding. The heat treatment at a higher temperature will produce a better product; however, an excessive high temperature results in insufficient insulation between the metal magnetic particles, so that the eddy-current loss increases adversely. The heat treatment is preferably done at a temperature ranging from 700° C. to 1000° C., inclusive. A heat treatment temperature equal to or higher than 700° C. allows releasing the process-strains sufficiently, and achieving high magnetic properties. A heat treatment temperature over 1000° C. will increase the eddy-current loss adversely. A non-oxide atmosphere is preferable as a heat treatment atmosphere in order to prevent the metal magnetic particles from being oxidized. For instance, inert gas such as argon gas, nitride gas, helium gas, or a reducing atmosphere such as hydrogen gas, or a vacuum atmosphere is preferable. In the compact employing an organic material as the insulator and having undergone the heat treatment at the foregoing temperature, the organic material is thermally decomposed, so that inorganic elements contained in the organic material are left as residue, which then serves a function of the insulator.

Composite magnetic body 20 thus produced is provided with a coil winding, thereby assembling a magnetic element, which can be in a toroidal shape, E-shape or other shapes.

Instead of this method, the mixed powder formed of first metal magnetic particles 12A, second metal magnetic particles 12B, and the insulator undergoes the pressure molding together with the coil simultaneously, thereby forming a coil-embedded type magnetic element. This magnetic element of the coil-embedded type is different from composite magnetic body 20 in the following points because this element undergoes the pressure molding with the coil being embedded.

The manufacturing of the coil-embedded type magnetic elements needs to adjust the molding pressure appropriately to avoid an insulation failure caused by a breakage of an insulating film on the coil surface. Since the coil is embedded during the pressure molding, the temperature of the heat treatment needs to fall within a certain range so as not to incur a remarkable decrease in the insulating function. Within this range the remarkable decrease caused by, for instance, a thermal decomposition of the insulating film on the coil surface can be avoided. To be more specific, the heat treatment is preferably done at a temperature ranging from 100° C. to 250° C. In a case where organic material is used for the insulator, the organic material is not thermally decomposed, and the organic material itself thus exists among the metal magnetic particles.

As discussed above, in the case of manufacturing the coil-embedded type magnetic coil, a lower molding pressure is used, and the heat treatment is done at a lower temperature, so that the magnetic properties thereof is lower than those of the composite magnetic body that is molded at a higher pressure, and undergoes the heat treatment at a higher temperature, and is assembled with the coil winding. However, the coil-embedded type does not need an erection tolerance, so that a greater cross sectional area of a magnetic path can be obtained, and a length of the magnetic path can be shortened. As a result, the coil-embedded type magnetic coil can exhibit good properties (e.g. inductance value) as an inductance component.

The molding pressure to be used in manufacturing the coil-embedded type magnetic element preferably falls within a range from 2 tons/cm$^2$ to 6 tons/cm$^2$, inclusive. The molding pressure equal to or greater than 2 tons/cm$^2$ allows increasing the filling factor of the metal magnetic particles as well as the inductance value. The molding pressure equal to or smaller than 6 tons/cm$^2$ allows preventing the insulating film on the coil surface which is embedded in the magnetic core from being broken, and suppressing insulation failures as an inductance component, so that the magnetic element of high withstanding voltage strength can be manufactured.

The foregoing discussion thus proves that magnetic elements can be produced using composite magnetic body 20. The magnetic elements can be manufactured in simpler steps, has better DC superposition characteristics, and invites less failures than the powder magnetic core disclosed in Unexamined Japanese Patent Publication No. 2000-188214.

Note that the conditions of the voids described in the first embodiment is applicable to the second embodiment. In this case, first metal magnetic particles 12A and second metal magnetic particles 12B of the second embodiment are mixed together, and the resultant mixture is used as the metal magnetic powder, to which the manufacturing method demonstrated in the first embodiment is applied. In this case, the advantages produced both in the first and the second embodiments can be obtained.

Hereinafter, specific examples of composite magnetic body 20 are demonstrated to show the advantages thereof.

Example 8

As the first metal magnetic particles, Fe—Si—Al based metal magnetic particles are employed. The particles has an average particle size of 22 μm and mass saturation magnetization as of 140 emu/g. As the second metal magnetic particles, various types of metal magnetic particles listed in table 8 are employed. The average particle sizes of the first and the second metal magnetic particles are measured with a micro-track particle size distribution meter. Silicone resin is added to these particles in an amount of 1.2 parts by weight with respect to 100 parts by weight of total of the first and the second metal magnetic particles, and a small amount of toluene is added, then, they are mixed together. The ratio of the second metal magnetic particles with respect to the metal magnetic powder in total is 20 wt %.

TABLE 8

| | Low magnetized fine particles | | | High magnetized fine particles | | |
|---|---|---|---|---|---|---|
| Sample No. | Material | Mass saturation magnetization σsL (emu/g) | Average particle size DL (μm) | Material | Mass saturation magnetization σsH (emu/g) | Average particle size DH (μm) |
| 201 | FeSiAl-based | 140 | 22 | FeSiAl-based | 156 | 11 |
| 202 | FeSiAl-based | 140 | 22 | FeNi-based | 175 | 2 |
| 203 | FeSiAl-based | 140 | 22 | Fe | 215 | 6.5 |
| 204 | FeSiAl-based | 140 | 22 | FeSi-based | 194 | 1.1 |
| 205 | FeSiAl-based | 140 | 22 | FeNi-based | 156 | 13 |
| 206 | FeSiAl-based | 140 | 22 | FeNi-based | 140 | 22 |
| 207 | FeSiAl-based | 140 | 22 | FeSiAl-based | 140 | 11 |
| 208 | FeSiAl-based | 140 | 22 | FeNi-based | 145 | 4.4 |

The resultant mixture undergoes a pressure molding at 12 tons/cm$^2$, and then undergoes a heat treatment in argon gas atmosphere at 850° C. for 1.0 hour to be toroidal-shaped cores as samples each having an outer diameter of 14 mm, an inner diameter of 10 mm, and a thickness of 2 mm.

As an evaluation of the DC superposition characteristics of the foregoing samples, a relative permeability are measured with the LCR meter in this condition: applied magnetic field is 85 Oe, and frequency is 120 kHz. Mass saturation magnetization as of each of the samples is measured with a sample-vibrating type magnetometer VSM at applied magnetic field of 15 kOe. Table 9 shows the evaluation result.

TABLE 9

| Sample No. | σsL/σsH | DH/DL | Relative permeability |
|---|---|---|---|
| 201 | 0.90 | 0.50 | 50 |
| 202 | 0.80 | 0.09 | 52 |
| 203 | 0.65 | 0.30 | 54 |
| 204 | 0.72 | 0.05 | 60 |

TABLE 9-continued

| Sample No. | σsL/σsH | DH/DL | Relative permeability |
|---|---|---|---|
| 205 | 0.90 | 0.59 | 44 |
| 206 | 1.00 | 1.00 | 28 |
| 207 | 1.00 | 0.50 | 36 |
| 208 | 0.97 | 0.20 | 40 |

As table 9 shows, when the mass saturation magnetization and the average particle sizes of the first metal magnetic particles and the second metal magnetic particles satisfy simultaneously the relations of σsL/σsH≤0.9 and DH/DL≤0.5, a high relative permeability and excellent DC superposition characteristics can be achieved even under a high DC magnetic field.

Example 9

As first metal magnetic particles, various types of metal magnetic particles having an average particle size of 18 μm and mass saturation magnetization as listed in table 10 are employed. As second metal magnetic particles, Fe—Si based metal magnetic particles are employed. The average particle size of the second magnetic particles is 1.1 μm and mass saturation magnetization as is 198 emu/g. The average particle sizes of the first and second metal magnetic particles are measured with the micro-track particle size distribution meter. The first and second metal magnetic particles are mixed together, and then titanium-based coupling member (0.7 part by weight) and butyral resin (0.7 part by weight) are added to the total amount (100 parts by weight) of the metal magnetic powder. Then a small amount of ethanol is added to them, and mixed together. The ratio of the second metal magnetic particles with respect to the metal magnetic powder in total is 18 wt %, and DH/DL=0.06.

TABLE 10

| Sample No. | Low-magnetized fine particles Material | Mass saturation magnetization σsL (emu/g) | Average particle size DL (μm) | High-magnetized fine particles Material | Mass saturation magnetization σsH (emu/g) | Average particle size DH (μm) |
|---|---|---|---|---|---|---|
| 209 | FeSi-based | 175 | 18 | FeSi-based | 198 | 1.1 |
| 210 | FeNi-based | 140 | 18 | FeSi-based | 198 | 1.1 |
| 211 | FeSiAl-based | 110 | 18 | FeSi-based | 198 | 1.1 |
| 212 | FeSiAl-based | 90 | 18 | FeSi-based | 198 | 1.1 |
| 213 | FeNi-based | 70 | 18 | FeSi-based | 198 | 1.1 |
| 214 | FeNi-based | 65 | 18 | FeSi-based | 198 | 1.1 |

The resultant mixture undergoes a pressure molding at 15 tons/cm$^2$, and then undergoes a heat treatment in nitrogen gas atmosphere at 780° C. for 0.5 hour To be toroidal-shaped cores as samples each having an outer diameter of 14 mm, an inner diameter of 10 mm, and a thickness of 2 mm.

As an evaluation of DC superposition characteristics of the foregoing samples, a relative permeability is measured with the LCR meter in this condition: applied magnetic field is 80 Oe, and frequency is 120 kHz. Mass saturation magnetization as of each of the samples is measured with a sample-vibrating type magnetometer VSM at applied magnetic field of 15 kOe. Table 11 shows the evaluation result.

TABLE 11

| Sample No. | σsL/σsH | DH/DL | Relative permeability |
|---|---|---|---|
| 209 | 0.88 | 0.06 | 60 |
| 210 | 0.71 | 0.06 | 62 |
| 211 | 0.56 | 0.06 | 57 |
| 212 | 0.45 | 0.06 | 56 |
| 213 | 0.35 | 0.06 | 54 |
| 214 | 0.33 | 0.06 | 47 |

As Table 11 shows, mass saturation magnetization as equal to or greater than 70 emu/g allows achieving an excellent DC superposition characteristics.

Example 10

As first metal magnetic particles, Fe—Ni based metal magnetic particles are employed. The average particle sizes of the first metal magnetic particles are listed in table 12 and mass saturation magnetization σs is 152 emu/g. As second metal magnetic particles, Fe particles are employed. The average particle sizes of the second metal magnetic particles are listed in table 12, and mass saturation magnetization σs is 190 emu/g. In this case, σsL/σsH=0.8. The average particle sizes of the first and second metal magnetic particles are measured with the micro-track particle size distribution meter.

TABLE 12

| Sample No. | Low-magnetized fine particles Material | Mass saturation magnetization σsL (emu/g) | Average particle size DL (μm) | High-magnetized fine particles Material | Mass saturation magnetization σsH (emu/g) | Average particle size DH (μm) |
|---|---|---|---|---|---|---|
| 215 | FeNi-based | 152 | 2 | Fe | 190 | 1 |
| 216 | FeNi-based | 152 | 5 | Fe | 190 | 1 |
| 217 | FeNi-based | 152 | 12 | Fe | 190 | 1 |
| 218 | FeNi-based | 152 | 25 | Fe | 190 | 0.1 |
| 219 | FeNi-based | 152 | 31 | Fe | 190 | 0.5 |
| 220 | FeNi-based | 152 | 58 | Fe | 190 | 1 |
| 221 | FeNi-based | 152 | 86 | Fe | 190 | 2 |
| 222 | FeNi-based | 152 | 100 | Fe | 190 | 1 |
| 223 | FeNi-based | 152 | 110 | Fe | 190 | 2 |
| 224 | FeNi-based | 152 | 1 | Fe | 190 | 0.5 |
| 225 | FeNi-based | 152 | 22 | Fe | 190 | 0.06 |

To these first and second metal magnetic particles in total amount of 100 parts by weight, silicone resin (0.8 part by weight) and acrylic resin (1.2 parts by weight) are added, and a small amount of toluene is added, then these materials are mixed together. The resultant mixed powder undergoes a pressure molding at 16 tons/cm$^2$, and then undergoes a heat treatment in argon gas atmosphere at 800° C. for 1.0 hour To be toroidal-shaped cores as samples each having an outer diameter of 14 mm, an inner diameter of 10 mm, and a thickness of 2 mm.

As an evaluation of the DC superposition characteristics of the foregoing samples, a relative permeability is measured with the LCR meter in this condition: applied magnetic field is 85 Oe, and frequency is 100 kHz. Core losses of the samples are measured with an AC B—H curve meter at the frequency of 100 kHz and the magnetic flux density of 0.1 T. Mass saturation magnetization as of each of the samples is measured with a sample-vibrating type magnetometer VSM at applied magnetic field of 15 kOe. Table 13 shows the evaluation result.

TABLE 13

| Sample No. | σsL/σsH | DH/DL | Relative permeability | Loss |
|---|---|---|---|---|
| 215 | 0.80 | 0.500 | 50 | 750 |
| 216 | 0.80 | 0.200 | 56 | 690 |
| 217 | 0.80 | 0.083 | 62 | 605 |
| 218 | 0.80 | 0.004 | 64 | 780 |
| 219 | 0.80 | 0.016 | 61 | 800 |
| 220 | 0.80 | 0.017 | 59 | 1020 |
| 221 | 0.80 | 0.023 | 55 | 1250 |
| 222 | 0.80 | 0.010 | 50 | 1300 |
| 223 | 0.80 | 0.018 | 47 | 1900 |
| 224 | 0.80 | 0.500 | 41 | 850 |
| 225 | 0.80 | 0.003 | 39 | 950 |

Sample No. 215 through sample No. 222 have average particle sizes equal to or greater than 2 μm and equal to or smaller than 100 μm. As table 13 shows, these samples exhibit better DC superposition characteristics and lower core losses than sample Nos. 223 and 224. Furthermore, the comparison between sample No. 218 and sample No. 225 proves that the second metal magnetic particles preferably have an average particle size equal to or greater than 0.1 μm from the viewpoint of the DC superposition characteristics.

Example 11

As first metal magnetic particles, Fe—Si—Al based metal magnetic particles are employed. The average particle size of the first metal magnetic particles is 25 μm and mass saturation magnetization as is 136 emu/g. As second metal magnetic particles, Fe—Si based metal magnetic particles are employed. The average particle size thereof is 2 μm, and mass saturation magnetization as is 186 emu/g. The first and second metal magnetic particles are mixed together at a ratio listed in table 14 for preparing the metal magnetic powder to be used in evaluation. In this case, σsL/σsH=0.73, and DH/DL=0.08. The average particle sizes of the first and the second metal magnetic particles are measured with the micro-track particle size distribution meter.

To these first and second metal magnetic particles in total amount of 100 parts by weight, aluminum oxide (0.1 part by weight) of which average particle size is 0.05 μm is added and mixed together, and silane-based coupling agent (0.5 part by weight) and butyral resin (0.5 part by weight) are added thereto, and a small amount of ethanol is added, then these materials are kneaded together. The resultant mixture undergoes a pressure molding at 12 tons/cm$^2$, and then undergoes a heat treatment in argon gas atmosphere at 750° C. for 1.5 hours to be toroidal-shaped cores as samples each having an outer diameter of 14 mm, an inner diameter of 10 mm, and a thickness of 2 mm.

As an evaluation of the DC superposition characteristics of the foregoing samples, a relative permeability is measured with the LCR meter in this condition: applied magnetic field is 85 Oe, and frequency is 120 kHz. Mass saturation magnetization as of each of the samples is measured with a sample-vibrating type magnetometer VSM at applied magnetic field of 15 kOe. Table 14 shows the evaluation result.

TABLE 14

| Sample No. | Low-magnetized fine particles (wt %) | High-magnetized fine particles (wt %) | Relative permeability |
|---|---|---|---|
| 226 | 98 | 2 | 49 |
| 227 | 95 | 5 | 57 |
| 228 | 88 | 12 | 59 |
| 229 | 76 | 21 | 61 |
| 230 | 70 | 30 | 51 |
| 231 | 99 | 1 | 40 |
| 232 | 68 | 32 | 42 |

Table 14 shows that the contents of the second metal magnetic particles falling within the range from 2 to 30 wt %, inclusive, allow exhibiting excellent DC superposition characteristics.

Example 12

As first metal magnetic particles, Fe—Si—Cr based metal magnetic particles are employed. The average particle size of the first metal magnetic particles is 12 μm and mass saturation magnetization as is 170 emu/g. As second metal magnetic particles, various types of metal magnetic particles listed in table 15 are employed. The average particle sizes of the first and the second metal magnetic particles are measured with the micro-track particle size distribution meter.

TABLE 15

| | Low-magnetized fine particles | | | High-magnetized fine particles | | |
|---|---|---|---|---|---|---|
| Sample No. | Material | Mass saturation magnetizationσsL (emu/g) | Average particle size DL (μm) | Material | Mass saturation magnetization σsH (emu/g) | Average particle size DH (μm) |
| 233 | FeSiCr-based | 170 | 12 | FeSi-based | 190 | 6 |
| 234 | FeSiCr-based | 170 | 12 | Fe | 200 | 1 |
| 235 | FeSiCr-based | 170 | 12 | Fe | 213 | 4.8 |
| 236 | FeSiCr-based | 170 | 12 | Fe | 213 | 1.2 |
| 237 | FeSiCr-based | 170 | 12 | FeSi-based | 190 | 7.1 |
| 238 | FeSiCr-based | 170 | 12 | FeSiCr-based | 170 | 12 |
| 239 | FeSiCr-based | 170 | 12 | FeNi-based | 170 | 6 |
| 240 | FeSiCr-based | 170 | 12 | FeSi-based | 180 | 3.6 |

These first and second metal magnetic particles in total amount of 100 parts by weight are mixed with mica (0.5 part by weight) having an average particles size of 3 μm, then epoxy resin (3.0 parts by weight) and amine-based curing agent (0.7 part by weight) are added thereto, and then they are mixed together for preparing a compound. The ratio of the second metal magnetic powder with respect to the total metal magnetic powder is 20 wt %. The resultant mixture undergoes a pressure molding at 4 tons/cm$^2$, and then undergoes a heat treatment in the air at 160° C. for 2.0 hours for curing the epoxy resin to be toroidal-shaped cores as samples each having an outer diameter of 14 mm, an inner diameter of 10 mm, and a thickness of 2 mm.

This example 12 aims to obtain a composite magnetic body of the coil-embedded type magnetic element, so that the heat treatment is done at 160° C. in order to prevent an organic material from thermally decomposing, and the organic material thus lies between the first metal magnetic particles and the second metal magnetic particles.

Next, as an evaluation of the DC superposition characteristics of the foregoing samples, a relative permeability is measured with the LCR meter in this condition: applied magnetic field is 90 Oe, and frequency is 120 kHz. Mass saturation magnetization as of each of the samples is measured with the sample-vibrating type magnetometer VSM at applied magnetic field of 15 kOe. Table 16 shows the evaluation result.

TABLE 16

| Sample No. | σsL/σsH | DH/DL | Relative permeability |
|---|---|---|---|
| 233 | 0.90 | 0.50 | 28 |
| 234 | 0.85 | 0.08 | 32 |
| 235 | 0.80 | 0.40 | 30 |
| 236 | 0.80 | 0.10 | 31 |
| 237 | 0.90 | 0.59 | 24 |
| 238 | 1.00 | 1.00 | 20 |
| 239 | 1.00 | 0.50 | 21 |
| 240 | 0.94 | 0.30 | 20 |

As table 16 shows, when the mass saturation magnetization and the average particle sizes of the first metal magnetic particles and the second metal magnetic particles satisfy simultaneously the relations of $\sigma sL/\sigma sH \leq 0.9$, $DH/DL \leq 0.5$, high relative permeability and excellent DC superposition characteristics can be achieved even under a high DC magnetic field.

INDUSTRIAL APPLICABILITY

Use of the composite magnetic body in accordance with the embodiments allows obtaining inductance components having advantageous features such as better productivity, smaller size, higher efficiency, higher yield in manufacturing, and higher reliability. The composite magnetic body is thus useful for various electronic apparatuses.

The invention claimed is:

1. A composite magnetic body comprising:

metal magnetic powder formed of metal magnetic particles; and an insulator impregnated into at least a part of voids between metal magnetic particles, wherein on a cumulative distribution curve of widths of the voids, a void width at which a cumulative distribution becomes 50% is equal to or smaller than 3 μm, and a void width at which the cumulative distribution becomes 95% is equal to or greater than 4 μm, the insulator includes a first polymer and a second polymer, the first polymer includes three or more side chains each of which is formed of carbon atoms or silicon atoms in a quantity ranging from 7 to 11 atoms inclusive, and includes or does not include one or two side chains formed of carbon atoms or silicon atoms in a quantity equal to or more than 12 atoms, and the second polymer includes or does not include one or two side chains formed of carbon atoms or silicon atoms in a quantity ranging from 7 to 11 atoms inclusive, and includes three or more side chains each of which is formed of carbon atoms or silicon atoms in a quantity equal to or greater than 12 atoms.

2. The composite magnetic body according to claim 1, wherein the metal magnetic powder contains first metal magnetic particles and second metal magnetic particles, and the first metal magnetic particles have mass saturation magnetization equal to or smaller than mass saturation magnetization of the second metal magnetic particles, and an average particle size of the first metal magnetic particles is equal to or greater than an average particle size of the second metal magnetic particles.

3. The composite magnetic body according to claim 2, wherein a value obtained by dividing the mass saturation magnetization of the first metal magnetic particles by the mass saturation magnetization of the second metal magnetic particles is equal to or smaller than 0.9, and a value obtained through dividing the average particle size of the second metal magnetic particles by the average particle size of the first metal magnetic particles is equal to or smaller than 0.5.

4. The composite magnetic body according to claim 2, wherein the first metal magnetic particles and the second metal magnetic particles contain at least Fe.

5. The composite magnetic body according to claim 2, wherein the mass saturation magnetization of the first metal magnetic particles is equal to or greater than 70 emu/g.

6. The composite magnetic body according to claim 2, wherein the average particle size of the first metal magnetic particles falls within a range from 2 μm to 100 μm, both inclusive.

7. The composite magnetic body according to claim 2, wherein the second metal magnetic particles are contained in an amount ranging from 2 wt % to 30 wt %, both inclusive.

8. A method for manufacturing a composite magnetic body, the method comprising the steps of:

mixing metal magnetic powder, formed of metal magnetic particles, with a first polymer and a second polymer for preparing granulated powder;

pressure-molding the granulated powder for producing a compact;

providing the compact with a heat treatment to decompose organic components in the first polymer and the second polymer for forming voids between the metal magnetic particles; and impregnating an insulator into at least a part of the voids, wherein on a cumulative distribution curve of widths of the voids, a void width, at which a cumulative distribution becomes 50%, is equal to or smaller than 3 and a void width, at which the cumulative distribution becomes 95%, is equal to or greater than 4 μm, wherein the first polymer includes three or more side chains each of which is formed of carbon atoms or silicon atoms in a quantity ranging from 7 to 11 atoms inclusive, and includes or does not include one or two side chains formed of carbon atoms or silicon atoms in a quantity equal to or more than 12 atoms, and wherein the second polymer includes or does not include one or two side chains formed of carbon atoms or silicon atoms in a quantity ranging from 7 to 11 atoms inclusive, and includes three or more side chains each of which is formed of carbon atoms or silicon atoms in a quantity equal to or greater than 12 atoms.

9. The method according to claim 8, wherein:

the metal magnetic particles contains first metal magnetic particles and second metal magnetic particles, the first metal magnetic particles have mass saturation magnetization equal to or smaller than mass saturation magnetization of the second metal magnetic particles, and an average particle size of the first metal magnetic particles is equal to or greater than an average particle size of the second metal magnetic particles.

10. The method according to claim 9, wherein a value obtained by dividing the mass saturation magnetization of the first metal magnetic particles by the mass saturation magnetization of the second metal magnetic particles is equal to or smaller than 0.9, and a value obtained through dividing the average particle size of the second metal magnetic particles by the average particle size of the first metal magnetic particles is equal to or smaller than 0.5.

11. The method according to claim 9, wherein the first metal magnetic particles and the second metal magnetic particles contain at least Fe.

12. The method according to claim 9, wherein the mass saturation magnetization of the first metal magnetic particles is equal to or greater than 70 emu/g.

13. The method according to claim 9, wherein the average particle size of the first metal magnetic particles falls within a range from 2 μm to 100 μm, both inclusive.

14. The method according to claim 9, wherein the second metal magnetic particles are contained in an amount ranging from 2 wt % to 30 wt %, both inclusive.

15. The method according to claim 8, wherein each of the first polymer and the second polymer is one selected from the group consisting of an epoxy resin, an acrylic resin, a phenolic resin and a butyral resin.

16. The method according to claim 8, wherein at least one of the first polymer and the second polymer is a silicone resin.

17. The composite magnetic body according to claim 1, wherein each of the first polymer and the second polymer is one selected from the group consisting of an epoxy resin, an acrylic resin, a phenolic resin and a butyral resin.

18. The composite magnetic body according to claim 1, wherein at least one of the first polymer and the second polymer is a silicone resin.

* * * * *